US010950172B2

(12) United States Patent
Cho et al.

(10) Patent No.: US 10,950,172 B2
(45) Date of Patent: Mar. 16, 2021

(54) PIXEL WITH SUPPLY-VOLTAGE INSENSITIVE DRIVE CURRENT AND DRIVING METHOD THEREOF

(71) Applicant: SAMSUNG DISPLAY CO., LTD., Yongin-si (KR)

(72) Inventors: Young Jin Cho, Yongin-si (KR); Chui Kyu Kang, Yongin-si (KR); Young In Hwang, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 122 days.

(21) Appl. No.: 15/043,389

(22) Filed: Feb. 12, 2016

(65) Prior Publication Data

US 2017/0061876 A1 Mar. 2, 2017

(30) Foreign Application Priority Data

Aug. 27, 2015 (KR) ..... 10-2015-0120976

(51) Int. Cl.
*G09G 3/3233* (2016.01)
*G09G 3/3258* (2016.01)

(52) U.S. Cl.
CPC ..... *G09G 3/3233* (2013.01); *G09G 3/3258* (2013.01); *G09G 2300/0819* (2013.01);
(Continued)

(58) Field of Classification Search
CPC ..... G09G 3/3233; G09G 3/3258; G09G 3/30–3291; G09G 2300/0819;
(Continued)

(56) References Cited

U.S. PATENT DOCUMENTS 7,692,613 B2 4/2010 Choi et al.
8,957,837 B2 2/2015 Han
(Continued)

FOREIGN PATENT DOCUMENTS

CN 1794327 A 6/2006
CN 102339586 A 2/2012
(Continued)

OTHER PUBLICATIONS

EPO Extended Search Report dated Nov. 4, 2016, for corresponding European Patent Application No. 16185809.7 (8 pages).
(Continued)

*Primary Examiner* — Keith D Bloomquist
(74) *Attorney, Agent, or Firm* — Lewis Roca Rothgerber Christie LLP

(57) ABSTRACT

A pixel includes an organic light emitting diode, a first transistor configured to control an amount of a current flowing from a first power to a second power via a second node and the organic light emitting diode in response to a voltage of a first node, a first capacitor between the first node and a third node, a second capacitor between the second node and the third node, a second transistor between the third node and a data line and including a gate electrode coupled to a scan line, and a third transistor between the first power and the second node and including a gate electrode coupled to a first emission control line.

20 Claims, 17 Drawing Sheets

(52) U.S. Cl.
CPC ..... *G09G 2300/0852* (2013.01); *G09G 2300/0861* (2013.01); *G09G 2300/0866* (2013.01); *G09G 2310/08* (2013.01)

(58) Field of Classification Search
CPC ... G09G 2300/0852; G09G 2300/0861; G09G 2300/0866; G09G 2310/08; G09G 2320/043; G09G 2310/0262
See application file for complete search history.

(56) References Cited

U.S. PATENT DOCUMENTS

| | | | | |
|---|---|---|---|---|
| 8,982,017 | B2 | 3/2015 | Lee et al. | |
| 9,093,026 | B2 * | 7/2015 | Woo | G09G 3/3233 |
| 9,100,998 | B2 * | 8/2015 | Yamamoto | G09G 3/3233 |
| 9,530,354 | B2 | 12/2016 | Tan et al. | |
| 9,721,507 | B2 | 8/2017 | Han | |
| 9,805,656 | B2 | 10/2017 | Hu et al. | |
| 2003/0156084 | A1 | 8/2003 | Tsuchiya et al. | |
| 2006/0066532 | A1 * | 3/2006 | Jeong | G09G 3/3233 345/76 |
| 2007/0118781 | A1 | 5/2007 | Kim | |
| 2009/0219232 | A1 * | 9/2009 | Choi | G09G 3/3233 345/76 |
| 2010/0141630 | A1 | 6/2010 | Kimura | |
| 2010/0149153 | A1 | 6/2010 | Yamamoto et al. | |
| 2010/0265166 | A1 * | 10/2010 | Kang | G09G 3/3233 345/76 |
| 2012/0306840 | A1 * | 12/2012 | Han | G09G 3/003 345/212 |
| 2013/0321249 | A1 | 12/2013 | Kimura | |
| 2014/0152719 | A1 | 6/2014 | Jung | |
| 2014/0198085 | A1 * | 7/2014 | Park | G09G 3/3233 345/207 |
| 2018/0130412 | A1 * | 5/2018 | Zhang | G09G 3/32 |

FOREIGN PATENT DOCUMENTS

| | | | |
|---|---|---|---|
| CN | 103354078 | A | 10/2013 |
| CN | 103927990 | A | 7/2014 |
| CN | 104700778 | A | 6/2015 |
| EP | 2 463 849 | A1 | 6/2012 |
| KR | 10-2013-0026338 | A | 3/2013 |

OTHER PUBLICATIONS

EPO Office Action dated Dec. 14, 2017, for corresponding European Patent Application No. 16185809.7 (6 pages).

* cited by examiner

PIXEL WITH SUPPLY-VOLTAGE INSENSITIVE DRIVE CURRENT AND DRIVING METHOD THEREOF

CROSS-REFERENCE TO RELATED APPLICATION

This application claims priority to, and the benefit of, Korean Patent Application No. 10-2015-0120976, filed on Aug. 27, 2015, in the Korean Intellectual Property Office, the entire content of which is incorporated herein by reference in its entirety.

BACKGROUND

1. Field

Embodiments of the present invention relate to a pixel and a driving method thereof.

2. Description of the Related Art

With development of information technology (IT), the importance of display devices (i.e., a medium between a user and information) is recognized. In response, usage of display devices, such as liquid crystal display (LCD) devices, organic light emitting display devices, etc. has increased.

Of the different types of display devices, the organic light emitting display device is configured to display an image using organic light emitting diodes emitting light by the recombination of electrons and holes, and has the advantages of quick response time and low power consumption.

An organic light emitting display device includes a plurality of pixels arranged in a matrix at respective crossing regions of a plurality of data lines, a plurality of scan lines, and a plurality of power lines. The pixels generally include two or more transistors including a driving transistor, one or more capacitors, and an organic light emitting diode.

While the organic light emitting display device may consume less power, the amount of current flowing to the organic light emitting diodes changes according to the threshold voltage deviation of a corresponding driving transistor included in each pixel, resulting in display irregularity. In other words, the characteristics of the driving transistors included in the pixels vary according to production process variables. To overcome this problem, there has been proposed a solution in which the driving transistor is connected in the form of a diode (e.g., is diode-connected) to compensate the threshold voltage of the driving transistor. However, when the driving transistor is diode-connected in the form of a diode, there may be 2 or more leakage paths from a gate electrode of the driving transistor. Therefore, the voltage of the gate electrode of the driving transistor is changed through a leakage path during a driving period, thereby decreasing reliability of display quality.

In addition, when the driving transistor is diode-connected, high voltage is applied as a data signal in consideration of the threshold voltage of the driving transistor. Accordingly, high power consumption becomes an issue.

SUMMARY

Embodiments of the present invention relate to a pixel capable of securing reliability of display quality, and a driving method thereof.

In an embodiment, a pixel may include an organic light emitting diode, a first transistor configured to control an amount of a current flowing from a first power to a second power via a second node and the organic light emitting diode in response to a voltage of a first node, a first capacitor between the first node and a third node, a second capacitor between the second node and the third node, a second transistor between the third node and a data line and including a gate electrode coupled to a scan line, and a third transistor between the first power and the second node and including a gate electrode coupled to a first emission control line.

The second transistor may be configured to be turned on in response to a scan signal supplied to the scan line during a first period when the third node is initialized, during a second period when a threshold voltage of the first transistor is compensated, and during a third period when a voltage corresponding to a data signal is stored.

A voltage of a reference power may be configured to be supplied to the data line during the first period and the second period, and the data signal may be configured to be supplied to the data line during the third period.

The voltage of the reference power may be configured to be within a voltage range of data signals configured to be supplied to the data line.

The second power may be configured to be a high voltage during the first period, during the second period, and during the third period such that the organic light emitting diode is configured to be turned off, and the second power may be configured to be a low voltage during a fourth period such that the organic light emitting diode is configured to be turned on.

The third transistor may be configured to be turned on during the first period, and may be configured to be turned off during the second period and during the third period.

The pixel may further include a fourth transistor between the second node and the first transistor, and including a gate electrode coupled to a first control line.

The fourth transistor may be configured to be turned on during the second period such that the organic light emitting diode emits light.

The pixel may further include a fifth transistor between the first node and a reference power, and including a gate electrode coupled to a second control line, and a sixth transistor between an anode electrode of the organic light emitting diode and the reference power, and including a gate electrode coupled to a third control line.

The fifth transistor and the sixth transistor may be configured to be turned on during the first period, during the second period, and during the third period, and may be configured to be turned off when the organic light emitting diode emits light.

The second control line may be electrically coupled to the third control line.

The reference power may be configured to be within a voltage range of data signals configured to be supplied to the data line.

The pixel may further include a seventh transistor between the first transistor and an anode electrode of the organic light emitting diode, and including a gate electrode coupled to a second emission control line.

The seventh transistor may be configured to be turned off during the first period, during the second period, and during the third period, and may be configured to be turned on during a fourth period.

The pixel may further include a fourth transistor between the first transistor and an anode electrode of the organic light emitting diode, and including a gate electrode coupled to a first control line.

The fourth transistor may be configured to be turned on during the second period such that the organic light emitting diode emits light.

The pixel may further include a fifth transistor between the first node and a reference power, and including a gate electrode coupled to a second control line, and a sixth transistor including a first electrode between an anode electrode of the organic light emitting diode and the first transistor, a gate electrode coupled to a third control line, and a second electrode coupled to the third control line.

The fifth transistor and the sixth transistor may be configured to be turned on during the first period, during the second period, and during the third period, and may be configured to be turned off when the organic light emitting diode emits light.

In an embodiment, a pixel may include an organic light emitting diode, a first transistor configured to control an amount of a current flowing from a first power coupled to a second power via a second node and the organic light emitting diode in response to a voltage of a first node, a first capacitor between the first node and a third node, a second capacitor between the second node and the third node, a second transistor between the first node and a data line and including a gate electrode coupled to a scan line, a third transistor between the first power and the second node, and including a gate electrode coupled to a first emission control line, and a fourth transistor between the second node and the first transistor, and including a gate electrode coupled to a first control line.

The second transistor may be configured to be turned on in response to a scan signal supplied to the scan line during a first period when the first node is initialized, during a second period when a threshold voltage of the first transistor is compensated, and during a third period when a voltage corresponding to a data signal is stored.

A voltage of a reference power may be configured to be supplied to the data line during the first period and the second period, and the data signal may be configured to be supplied to the data line during the third period.

The voltage of the reference power may be configured to be within a voltage range of data signals configured to be supplied to the data line.

The second power may be set to a high voltage during the first to third periods such that the organic light emitting diode is configured to be turned off and may be set to a low voltage during other period such that the organic light emitting diode is configured to be turned on.

The third transistor may be configured to be turned on during the first period and may be configured to be turned off during the second period and the third period.

The fourth transistor may be configured to be turned on during the second period and when the organic light emitting diode emits light.

The pixel may further include a fifth transistor between the third node and a reference power and including a gate electrode coupled to a second control line, and a sixth transistor between an anode electrode of the organic light emitting diode and the reference power and including a gate electrode coupled to a third control line.

The fifth transistor and the sixth transistor may be configured to be turned on during the first period, the second period and the third period, and are configured to be turned off when the organic light emitting diode emits light.

The second control line and the third control line may be electrically coupled.

The reference power may be configured to be within a voltage range of data signals configured to be supplied to the data line.

The pixel may further include a fifth transistor between the third node and a reference power, and including a gate electrode coupled to a second control line, and a sixth transistor between an anode electrode of the organic light emitting diode and an initialization power, and including a gate electrode coupled to a third control line.

The fifth transistor and the sixth transistor may be configured to be turned on during the first period, during the second period, and during the third period, and may be configured to be turned off when the organic light emitting diode emits light.

The reference power may be configured to be within a voltage range of data signals configured to be supplied to the data line, and the initialization power may be configured to have a lower voltage than that of data signals configured to be supplied to the data line.

The pixel may further include a fifth transistor between the third node and a reference power, and including a gate electrode coupled to a second control line, and a sixth transistor including a first electrode coupled to an anode electrode of the organic light emitting diode, a gate electrode coupled to a third control line, and a second electrode coupled to the third control line.

The fifth transistor and the sixth transistor may be configured to be turned on during the first period, during the second period, and during the third period, and may be configured to be turned off when the organic light emitting diode emits light.

The pixel may further include a seventh transistor between the first transistor and an anode electrode of the organic light emitting diode, and including a gate electrode coupled to a second emission control line.

The seventh transistor may be configured to be turned off during the first period, the second period, and the third period, and may be configured to be turned on during a fourth period.

In an embodiment, a method of driving a pixel including a first transistor configured to control an amount of a current flowing from a first power to a second power via a second node and an organic light emitting diode in response to a voltage of a first node, a first capacitor between the first node and a third node, and a second capacitor between the second node and the third node, the method including supplying a voltage of a reference power to the first node and to the third node, supplying a voltage of the first power to the second node, maintaining the voltage of the reference power at the first node and at the third node, blocking electrical coupling between the second node and the first power, supplying the voltage of the reference power to the first node, supplying a voltage of a data signal to the third node, and controlling an amount of a current supplied from the first transistor to the organic light emitting diode in response to voltages of the first capacitor and the second capacitor.

The method may further include setting the reference power within a voltage range of data signals.

The method may further include setting the voltage of the second node to a sum of the voltage of the reference power and a threshold voltage of the first transistor during the blocking the electrical coupling.

The method may further include setting the second node to a floating state during the supplying of the voltage of the data signal to the third node.

In an embodiment, a method of driving a pixel including a first transistor configured to control an amount of a current flowing from a first power to a second power via a second node and an organic light emitting diode in response to a voltage of a first node, a first capacitor between the first node and a third node, and a second capacitor between the second node and the third node, the method including supplying a voltage of a reference power to the first node and to the third node, supplying a voltage of the first power to the second node, maintaining the voltage of the reference power supplied to the first node and to the third node, blocking electrical coupling between the second node and the first power, supplying the voltage of the reference power to the third node, supplying a voltage of a data signal to the first node, and controlling an amount of a current supplied from the first transistor to the organic light emitting diode in response to voltages of the first capacitor and the second capacitor.

The method may further include setting the reference power within a voltage range of data signals.

The method may further include setting the voltage of the second node to a sum of the voltage of the reference power and a threshold voltage of the first transistor during the blocking the electrical coupling.

The method may further include setting the second node to a floating state during the supplying of the voltage of the data signal to the third node.

In an embodiment, a pixel, and a method of driving the same, may control the amount of the current supplied to the organic light emitting diode regardless of a voltage drop of the threshold voltage of the driving transistor and the voltage of the first power. Also, only one leakage path is formed from the gate electrode of the driving transistor. Accordingly, reliability of display qualities may be secured. Additionally, the data signal may be directly supplied to the capacitors, and accordingly, power consumption may be reduced by lowering the voltage range of the data signal.

BRIEF DESCRIPTION OF THE DRAWINGS

Example embodiments will now be described more fully hereinafter with reference to the accompanying drawings, wherein.

DETAILED DESCRIPTION

Figure 1:
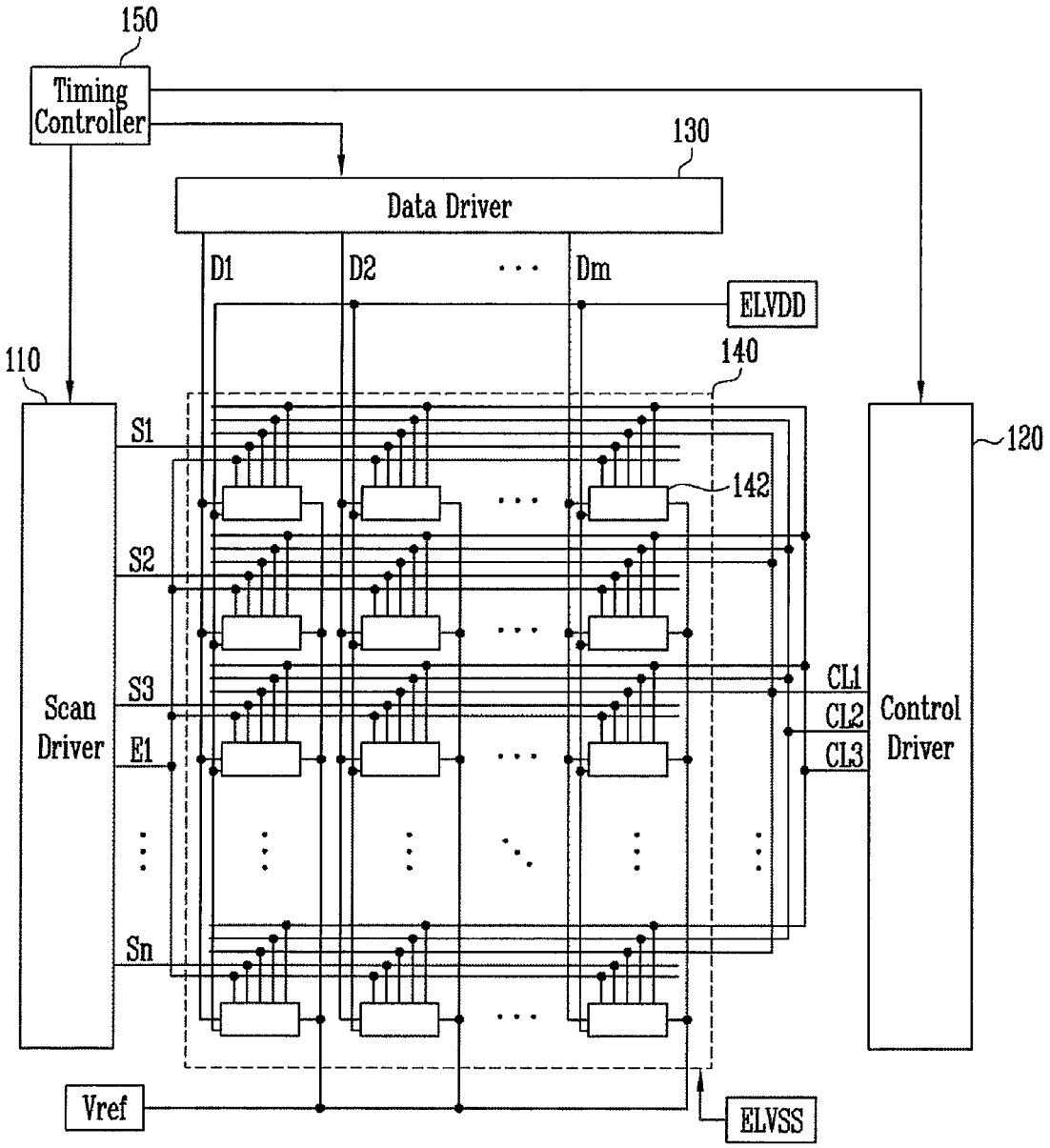
FIG. 1 illustrates an organic light emitting diode display device in accordance with an embodiment.

Features of the inventive concept and methods of accomplishing the same may be understood more readily by reference to the following detailed description of embodiments and the accompanying drawings. The inventive concept may, however, be embodied in many different forms and should not be construed as being limited to the embodiments set forth herein. Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 illustrates an organic light emitting diode display device in accordance with an embodiment.

Referring to FIG. 1, an organic light emitting diode display device according to an embodiment may include pixels 142 provided at respective crossing regions of scan lines S1 to Sn and data lines D1 to Dm, a scan driver 110 for driving the scan lines S1 to Sn and a first emission control line E1, a control driver 120 for driving a first control line CL1, a second control line CL2 and a third control line CL3, a data driver 130 for driving the data lines D1 to Dm, and a timing controller 150 for controlling the scan driver 110, the control driver 120 and the data driver 130.

The scan driver 110 may supply a scan signal to the scan lines S1 to Sn, and may supply scan signals to the scan lines Si to Sn sequentially or concurrently, depending on a method for driving the pixels 142.

The scan driver 110 may supply a first emission control signal to a first emission control line E1 commonly coupled to the pixels 142. For example, but without limitation, the scan driver 110 may supply a first emission control signal to the first emission control line E1 such that it overlaps the scan signals supplied to the scan lines S1 to Sn.

Additionally, although FIG. 1 shows the first emission control line E1 as being commonly coupled to the pixels 142, the present invention is not limited thereto. For example, if the pixels 142 are driven sequentially, the first emission control line E1 may be formed at every row with the scan lines S1 to Sn. Meanwhile, the scan signal supplied from the scan driver 110 may be a gate on voltage, such that a transistor included in the pixels 142 may be turned on, and the first emission control signal may be set to a gate off voltage, such that another transistor included in the pixels 142 may be turned off.

The control driver 120 may supply a first control signal to a first control line CL1, a second control signal to a second control line CL2, and a third control signal to a third control line CL3, the first to third control lines CL1 to CL3 each being commonly coupled to the pixels 142. The supply timing of the first control signal to the third control signal will be described with reference to a waveform diagram described below. Additionally, although FIG. 1 shows the first control line CL1 to the third control line CL3 to be commonly coupled to the pixels 142, the present invention is not limited thereto. For example, if the pixels 142 are driven sequentially, the first control line CL1 to the third control line CL3 may be formed at every parallel line (e.g., every row). Meanwhile, the first control signal to the third control signal supplied from the scan driver 110 may be a gate on voltage such that a corresponding transistor included in the pixels 142 may be turned on.

The data driver 130 may supply a voltage of a reference power Vref, and may supply a data signal to the data lines D1 to Dm. Here, the reference power Vref may be within a voltage range of the data signals capable of being supplied from the data driver 130.

The timing controller 150 may control the scan driver 110, the control driver 120 and the data driver 130 in response to synchronization signals supplied from outside.

A display unit 140 refers to a display area where images may be displayed. The display unit 140 may include the pixels 142 provided in an area defined by the scan lines S1 to Sn, the data lines D1 to Dm, the first emission control line E1, the first control line CL1, the second control line CL2 and the third control line CL3. The pixels 142 may charge a voltage corresponding to the reference power Vref and the data signal while passing through an initialization period, through a threshold voltage compensation period, and through a data writing period, and may control an amount of a current flowing from a first power ELVDD to a second power ELVSS via an organic light emitting diode. As such, the organic light emitting diode may generate light having luminance corresponding to an amount of current therethrough during a light emission period.

Additionally, a voltage of the second power ELVSS may maintain a high voltage during the initialization period, during the threshold voltage compensation period, and during the data writing period, and may maintain a low voltage during the light emission period. Here, the high voltage refers to a voltage where the pixels 142 do not emit light, and the low voltage refers to a voltage where the pixels 142 may emit light.

Also, although FIG. 1 shows that the first emission control line E1 is driven by the scan driver 110, and that the first control line CL1 to the third control line CL3 are controlled by the control driver 120, the present invention is not limited thereto. For example, drivers for driving each of the lines E1, CL1, CL2, and CL3 may be added, or one driver may drive all of the lines E1, CL1, CL2, and CL3.

Figure 2:
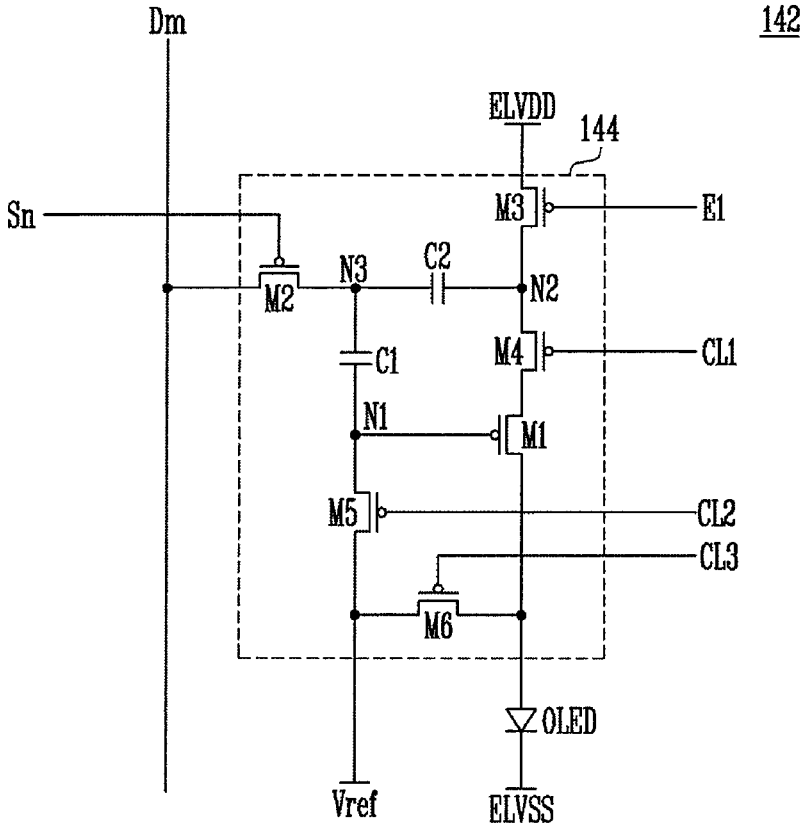
FIG. 2 illustrates a pixel according to a first embodiment.

FIG. 2 illustrates a pixel according to a first embodiment. FIG. 2 shows a pixel coupled to an m-th data line Dm and an n-th scan line Sn.

Referring to FIG. 2, the pixel 142 according to the present embodiment may include an organic light emitting diode OLED, and a pixel circuit 144 for controlling an amount of a current supplied to the organic light emitting diode OLED.

An anode electrode of the organic light emitting diode OLED may be coupled to the pixel circuit 144, and a cathode electrode of the organic light emitting diode OLED may be coupled to a second power ELVSS. The organic light emitting diode OLED may generate light having luminance corresponding to an amount of a current supplied from the pixel circuit 144. For this, the first power ELVDD may be set to a voltage that is higher than a voltage of the second power ELVSS during a light emission period.

The pixel circuit 144 may control the amount of the current flowing to the organic light emitting diode OLED in response to a data signal. For this, the pixel circuit 144 may include first to sixth transistors M1 to M6, a first capacitor C1, and a second capacitor C2.

A first electrode of the first transistor M1 may be coupled to the first power ELVDD via the fourth transistor M4, a second node N2, and the third transistor M3. A second electrode of the first transistor M1 may be coupled to the anode electrode of the organic light emitting diode OLED. A gate electrode of the first transistor M1 may be coupled to a first node N1. The first transistor M1 may control the amount of the current flowing to the second power ELVSS from the first power ELVDD via the organic light emitting diode OLED in response to a voltage of the first node N1.

The second transistor M2 may be coupled between the data line Dm and a third node N3. The gate electrode of the second transistor M2 may be coupled to the scan line Sn. The second transistor M2 may be turned on when the scan signal is supplied to the scan line Sn, thereby electrically coupling the data line Dm and the third node N3.

The third transistor M3 may be coupled between the first power ELVDD and the second node N2. The gate electrode of the third transistor M3 may be coupled to the first emission control line E1. The third transistor M3 may be turned off when the first emission control signal is supplied to the first emission control line E1, and may be turned on in other situations. When the third transistor M3 is turned on, the voltage of the first power ELVDD may be supplied to the second node N2.

The fourth transistor M4 may be coupled between the second node N2 and the first electrode of the first transistor M1. The gate electrode of the fourth transistor M4 may be coupled to the first control line CL1. The fourth transistor M4 may be turned on when the first control signal is supplied to the first control line CL1, thereby electrically coupling the first transistor M1 and the second node N2.

The fifth transistor M5 may be coupled between the first node N1 and the reference power Vref. The gate electrode of the fifth transistor M5 may be coupled to the second control line CL2. The fifth transistor M5 may be turned on when the second control signal is supplied to the second control line CL2, thereby supplying the voltage of the reference power Vref to the first node N1. The reference power Vref may be within a voltage range of the data signals capable of being supplied from the data driver 130.

The sixth transistor M6 may be coupled between the anode electrode of the organic light emitting diode OLED and the reference power Vref. The gate electrode of the sixth transistor M6 may be coupled to the third control line CL3. The sixth transistor M6 may be turned on when the third control signal is supplied to the third control line CL3, thereby supplying the voltage of the reference power Vref to the anode electrode of the organic light emitting diode OLED.

The first capacitor Cl may be coupled between the first node N1 and the third node N3. The second capacitor C2 may be coupled between the second node N2 and the third node N3. The first capacitor C1 and the second capacitor C2 may respectively charge a certain voltage corresponding to the data signal.

Figure 3:
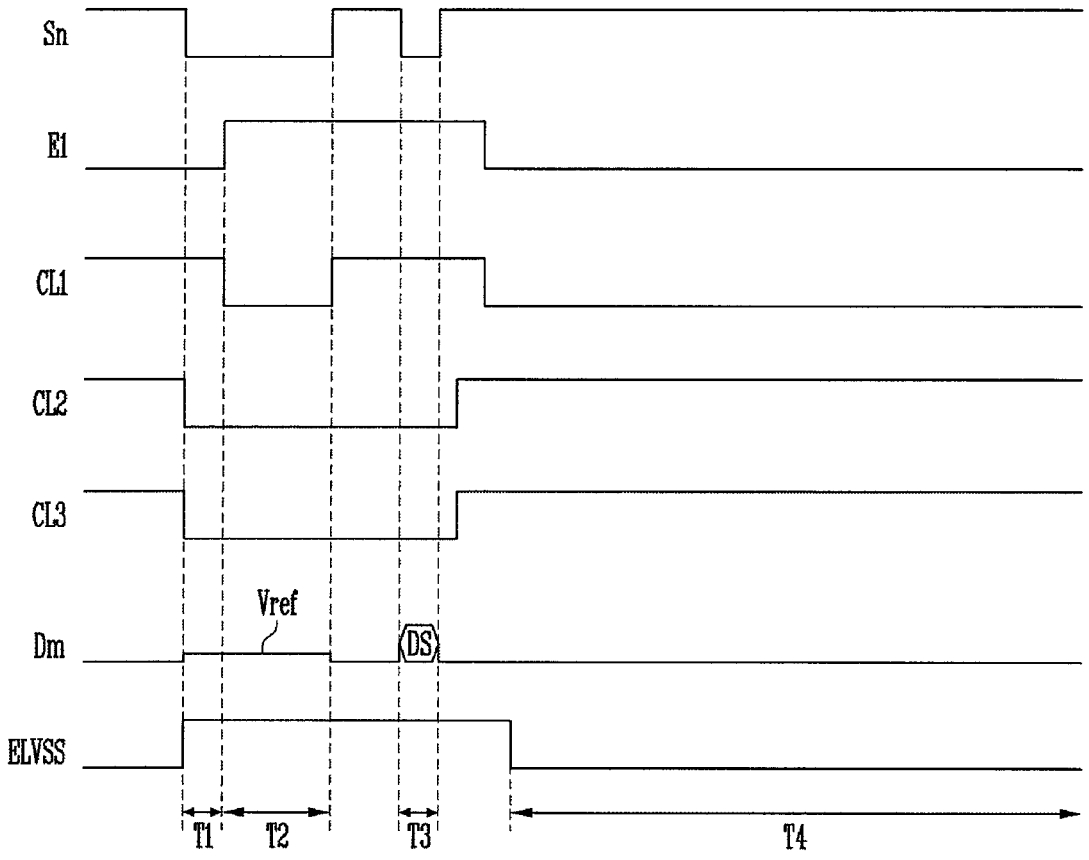
FIG. 3 illustrates an embodiment of a method for driving the pixel shown in FIG. 2.

FIG. 3 illustrates an embodiment of a method for driving the pixel shown in FIG. 2.

Referring to FIG. 3, the pixel 142 may be driven in a first period T1, which is an initialization period, may be driven in a second period T2, which is a threshold voltage compensation period, may be driven in a third period T3, which is a data writing period, and may be driven in a fourth period T4, which is a light emission period.

The scan signal may be supplied to the scan line Sn during the first period T1, the second period T2, and the third period T3. The first emission control signal may be supplied to the first emission control line E1 during the second period T2 and during the third period T3. The first control signal may be supplied to the first control line CL1 during the second period T2 and the fourth period 14. The second control signal may be supplied to the second control line CL2, and the third control signal may be supplied to the third control line CL3, during the first period T1 to the third period T3.

The data driver 130 may supply the voltage of the reference power Vref to the data line Dm during the first period T1 and the second period T2, and may supply the data signal DS to the data line Dm during the third period T3. The second power ELVSS may be set to a high voltage during the first period T1 to the third period T3, and may be set to a low voltage during the fourth period 14.

The operations are described in detail as follows. The second transistor M2 may be turned on in response to the scan signal supplied to the scan line Sn during the first period T1. The fifth transistor M5 may be turned on response to the second control signal supplied to the second control line CL2. The sixth transistor M6 may be turned on in response to the third control signal supplied to the third control line CL3.

When the sixth transistor M6 is turned on, the voltage of the reference power Vref may be supplied to the anode electrode of the organic light emitting diode OLED. When the second transistor M2 is turned on, the data line Dm and the third node N3 may be electrically coupled, and the voltage of the reference power Vref from the data line Dm may be supplied to the third node N3. When the fifth transistor M5 is turned on, the voltage of the reference power Vref may be supplied to the first node N1. Here, the third node N3 and the first node N1 may be set to the same voltage, and accordingly, the first capacitor C1 may be initialized. Additionally, because the third transistor M3 is turned on during the first period T1, the second node N2 may be set to the voltage of the first power ELVDD.

During the second period T2, the first emission control signal may be supplied to the first emission control line E1, thereby turning off the third transistor M3. During the second period 12, the first control signal may be supplied to the first control line CL1, thereby turning on the fourth transistor M4.

When the third transistor M3 is turned off, the first power ELVDD and the second node N2 may be electrically blocked. When the fourth transistor M4 is turned on, the second node N2 and the first transistor M1 may be electrically coupled.

Here, during the second period T2, the first node N1 and the third node N3 may maintain the voltage of the reference power Vref. Accordingly, during the second period T2, the voltage of the second node N2 may drop from the voltage of the first power ELVDD to a voltage that is the sum of the reference power Vref and the threshold voltage of the first transistor M1. The voltage that corresponds to the threshold voltage of the first transistor M1 may be stored in the second capacitor C2. Additionally, because the second power ELVSS is set to a high voltage, the current from the first transistor M1 may flow to the reference power Vref via the sixth transistor M6.

The supply of the first control signal to the first control line CL1 may be stopped during the third period T3. Accordingly, the fourth transistor M4 may be turned off. During the third period T3, the data signal DS may be supplied to the data line Dm.

The data signal DS supplied to the data line Dm may be supplied to the third node N3. The third node N3 may be set to the voltage of the data signal DS. Here, the first node N1 may maintain the voltage of the reference power Vref, and accordingly, the voltage corresponding to the data signal DS may be stored in the first capacitor C1. Additionally, during the third period T3, the second node N2 may be set to a floating state, and accordingly, the second capacitor C2 may maintain the voltage charged in a previous period. In other words, the voltage of the first node N1, the voltage of the second node N2, and the voltage of the third node N3 during the third period T3 may be determined by the following Formula 1.

$$N1=Vref\ N2=Vref+Vth+\Delta N2=Vdata+Vth\ N3=Vdata\ (\Delta N2=Vdata-Vref) \quad \text{Formula 1}$$

In Formula 1 above, Vref refers to the voltage of the reference power, Vdata refers to the voltage of the data signal DS, ΔN2 refers to the amount of voltage change of the second node N2, and Vth refers to the threshold voltage of the first transistor M1.

The supply of the first emission control signal to the first emission control line E1 may be stopped during the fourth period T4, thereby turning on the third transistor M3. Also, the supply of the scan signal to the scan line Sn may be stopped, thereby turning off the second transistor M2. Also, during the fourth period T4, the first control signal may be supplied to the first control line CL1, thereby turning on the fourth transistor M4. Also, the supply of the second control signal and the third control signal to the second control line CL2 and the third control line CL3 may be stopped, thereby turning off the fifth transistor M5 and the sixth transistor M6.

When the third transistor M3 is turned on, the voltage of the first power ELVDD may be supplied to the second node N2. The voltage of the second node N2 may increase to the voltage of the first power ELVDD from the voltage that is a sum of the voltage of the reference power Vref and the threshold voltage of the first transistor M1. Here, because the third node N3 and the first node N1 are set to a floating state, the first capacitor C1 and the second capacitor C2 may maintain the voltage of the previous period. The voltage of the first node N1, the second node N2, and the third node N3 during the fourth period 14 may correspond to Formula 2 below.

$$N1=Vref+\Delta N2=Vref+ELVDD-(Vdata+Vth)\ N2=ELVDD\ N3=Vdata+\Delta N2=ELVDD-Vth \quad \text{Formula 2}$$

When the fourth transistor M4 is turned on, the second node N2 and the first transistor M1 are electrically coupled. The first transistor M1 may control the amount of the current that flows from the first power ELVDD to the second power ELVSS via the organic light emitting diode OLED in response to the voltage of the first node N1. Therefore, the organic light emitting diode OLED may generate light having a luminance corresponding to the amount of the current supplied from the first transistor M1 during the fourth period 14. Additionally, the current, which may be represented as current I, and which is supplied from the first transistor M1 to the organic light emitting diode, corresponds to Formula 3 below.

$$\begin{aligned} I &= k(Vsg-|Vth|)^2 \quad \text{Formula 3} \\ &= k(ELVDD-Vref-ELVDD+Vdata+Vth-|Vth|)^2 \\ &= k(Vdata-Vref)^2 \end{aligned}$$

In Formula 3, k refers to a constant. Referring to Formula 3, the current I flowing from the first transistor M1 to the organic light emitting diode OLED may correspond to a voltage difference between a voltage Vdata of the data signal DS and a voltage of the reference power Vref. Here, the reference power Vref is a static voltage. Therefore, the current I supplied to the organic light emitting diode OLED may correspond to the voltage of the data signal DS.

Also, as shown in Formula 3, the current I supplied to the organic light emitting diode OLED may be determined without reference to the first power ELVDD and the threshold voltage Vth of the first transistor M1. Therefore, the current I may be supplied to the organic light emitting diode OLED regardless of the difference between the voltage drop of the first power ELVDD and the threshold voltage of the first transistor M1. Accordingly, reliability of image quality may be secured.

Additionally, the data signal DS may be directly supplied to the capacitors C1 and C2, and accordingly, consumption of power may be decreased as the voltage range of the data signal DS is lowered. In addition, the pixel 142 may form only one leakage path from the first node N1 (e.g., a path from M5 to Vref), and accordingly, reliability of image quality may be secured. Furthermore, because the reference power Vref included in the leakage path is set to be within the voltage range of the data signals DS, leakage current due to the leakage path may be reduced or minimized.

The pixels 142 may generate light having luminance by repeating the first period T1 to the fourth period T4.

Figure 4:
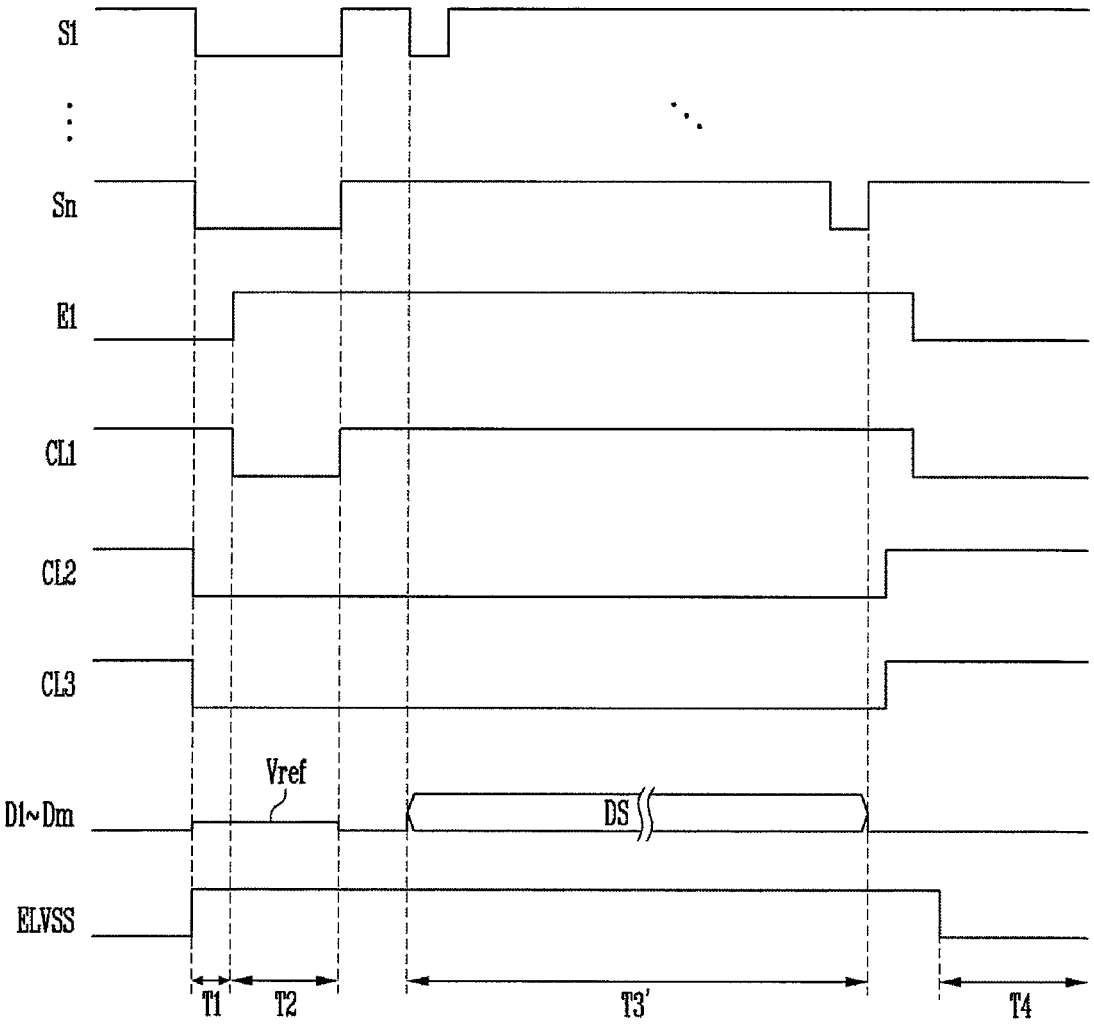
FIG. 4 illustrates an embodiment in which the driving waveform shown in FIG. 3 is applied in concurrent driving.

FIG. 4 illustrates an embodiment in which the driving waveform shown in FIG. 3 is applied in concurrent driving.

Referring to FIG. 4, if the pixels 142 are driven concurrently, the scan signals may be concurrently supplied to the scan lines S1 to Sn during the first period T1 and the second period T2. The threshold voltage of the first transistor M1 may be compensated in each of the pixels 142 during the first period T1 and the second period T2.

If the pixels 142 concurrently compensate the threshold voltage, sufficient time may be allocated during the second period T2, and accordingly, each of the pixels 142 may compensate the threshold voltage of the first transistor M1 in a stable manner.

During a third period T13', the scan signal may be sequentially supplied to the scan lines S1 to Sn, and the data signal DS may be supplied to the data lines D1 to Dm. The pixels 142 may be sequentially selected by the scan signal supplied to the scan lines S1 to Sn, and may store the voltage corresponding to the data signal DS.

During the fourth period T4, the pixels 142 may concurrently emit light corresponding to the voltage of the data signal DS stored during the third period T3'.

The driving waveform shown in FIG. 4 illustrates the data signal DS being sequentially stored in horizontal line units. The pixels 142 are driven in a substantially similar manner as the driving waveform shown in FIG. 3.

Figure 5:
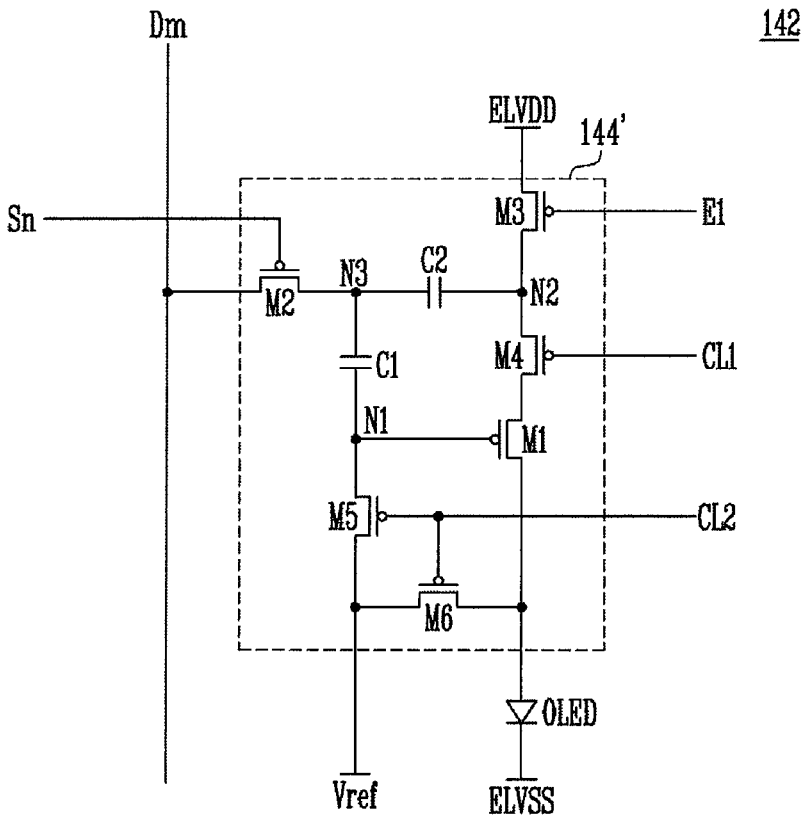
FIG. 5 illustrates a pixel according to a second embodiment.

FIG. 5 illustrates a pixel according to a second embodiment. As FIG. 5 is explained, the components that are the same as those in FIG. 2 will be given the same reference numerals, and any repetitive description will be omitted.

Referring to FIG. 5, a pixel 142 according to the present embodiment may include an organic light emitting diode OLED and a pixel circuit 144' for controlling an amount of a current supplied to the organic light emitting diode OLED.

A gate electrode of a sixth transistor M6 included in the pixel circuit 144' may be coupled to a second control line CL2. In detail, as shown in FIG. 3, a second control signal supplied to the second control line CL2, and a third control signal supplied to a third control line CL3 may be set to the same waveform. That is, in the present embodiment, the second control line CL2 and the third control line CL3 shown in FIG. 2 may be electrically coupled. Therefore, even though the third control line CL3 is omitted, and even though the sixth transistor M6 is coupled to the second control line CL2, the pixel 142 may be driven in the same manner.

Figure 6:
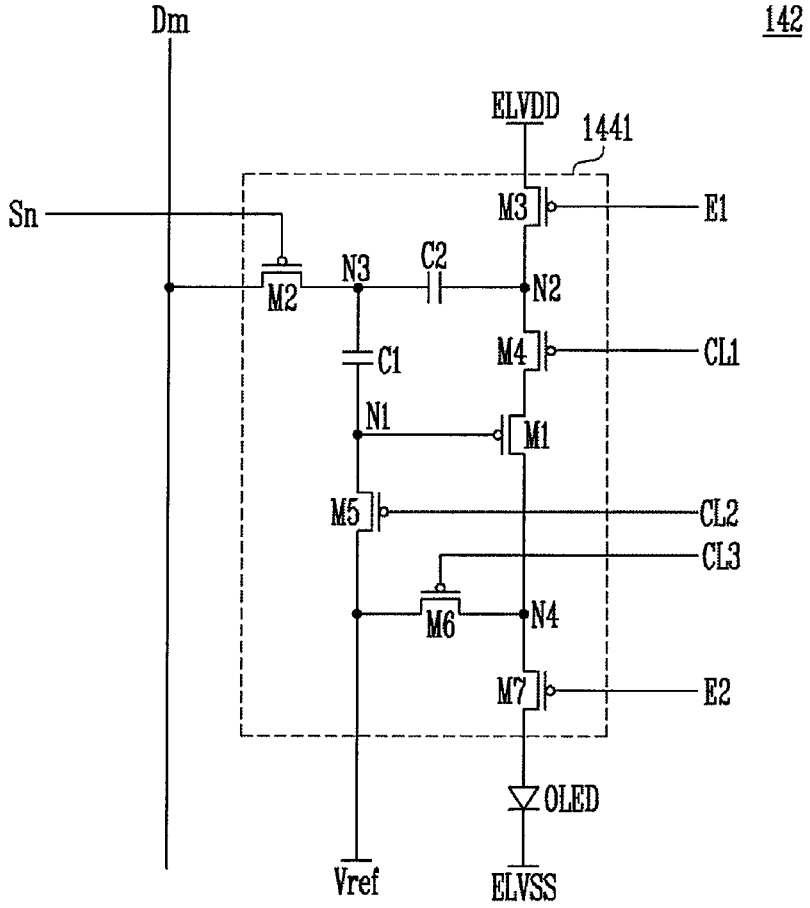
FIG. 6 illustrates a pixel according to a third embodiment.

FIG. 6 illustrates a pixel according to a third embodiment. As FIG. 6 is explained, the components that are the same as those in FIG. 2 will be given the same reference numerals, and any repetitive description will be omitted.

Referring to FIG. 6, a pixel 142 according to the present embodiment may include an organic light emitting diode OLED, and may include a pixel circuit 1441 for controlling an amount of a current supplied to the organic light emitting diode OLED.

The pixel circuit 1441 may include first to seventh transistors M1 to M7. The seventh transistor M7 may be coupled between an anode electrode of the organic light emitting diode OLED and a second electrode of the first transistor M1. In more detail, The seventh transistor M7 may be coupled between a fourth node N4, which is a common node of the sixth transistor M6 and the first transistor M1, and the anode electrode of the organic light emitting diode OLED. The gate electrode of the seventh transistor M7 may be coupled to a second emission control line E2.

The seventh transistor M7 may be turned off when the second emission control signal is supplied to the second emission control line E2, and may be turned on otherwise. For example, but without limitation, the seventh transistor M7 may be turned off during the first period T1, the second period T2, and the third period T3, and may be turned on during the fourth period T4.

If the seventh transistor M7 is turned off during the first period T1 to the third period T3, the second power ELVSS may maintain a low voltage during the first period T1 to the third period T3. That is, if the seventh transistor M7 is included in the pixel 142, the second power ELVSS may maintain a low voltage during the first period T1 to the fourth period T4.

Figure 7:
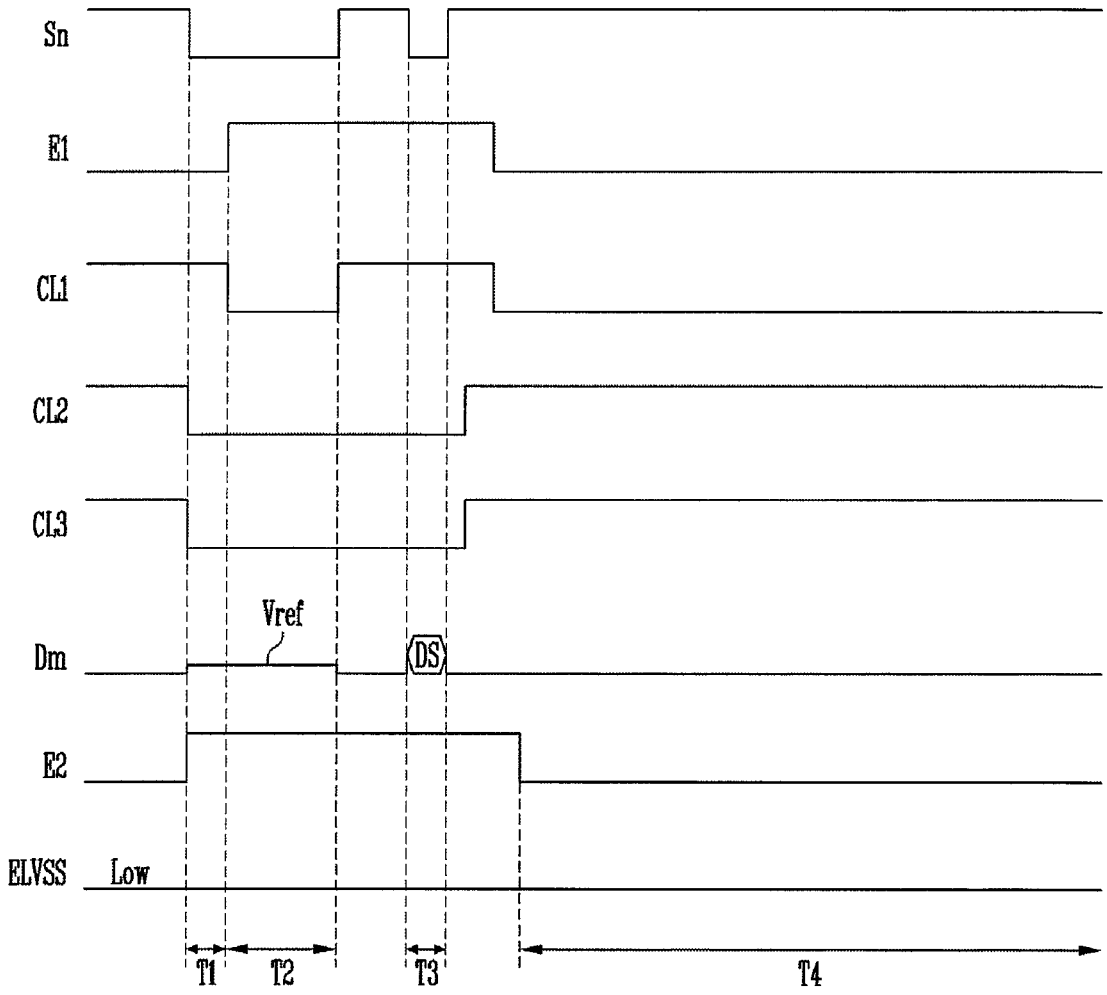
FIG. 7 illustrates an embodiment of a method for driving the pixel shown in FIG. 6.

FIG. 7 illustrates an embodiment of a method for driving the pixel shown in FIG. 6.

Referring to FIG. 7, the second emission control signal is supplied to the second emission control line E2 during the first period T1 to the third period T3, and accordingly, the seventh transistor M7 may be turned off. When the seventh transistor M7 is turned off, the first transistor M1 and the organic light emitting diode OLED are electrically blocked. The second power ELVSS may maintain a low voltage Low during the first period T1 to the fourth period T4.

The second transistor M2 may be turned on during the first period T1 in response to the scan signal supplied to the scan line Sn. The fifth transistor M5 may be turned on in response to the second control signal supplied to the second control line CL2, and the sixth transistor M6 may be turned on in response to the third control signal supplied to the third control line CL3.

When the sixth transistor M6 is turned on, the voltage of the reference power Vref may be supplied to the fourth node N4. When the second transistor M2 is turned on, the voltage of the reference power Vref may be supplied to the third node N3 from the data line Dm. When the fifth transistor M5 is turned on, the voltage of the reference power Vref may be supplied to the first node N1. Here, the third node N3 and the first node N1 are set to the same voltage, and accordingly, the first capacitor C1 may be initialized. Additionally, because the third transistor M3 maintains a turn on state during the first period T1, the second node N2 may be set to the voltage of the first power ELVDD.

The third transistor M3 is turned off as the first emission control signal is supplied to the first emission control line E1 during the second period T2. The fourth transistor M4 is turned on as the first control signal is supplied to the first control line CL1 during the second period 12.

When the third transistor M3 is turned off, the first power ELVDD and the second node N2 may be electrically blocked. When the fourth transistor M4 is turned on, the second node N2 and the first transistor M1 may be electrically coupled. Here, the first node N1 and the third node N3 may maintain the voltage of the reference power Vref during the second period 12. Accordingly, during the second period 12, the voltage of the second node N2 may drop from the voltage of the first power ELVDD to a voltage that is a sum of the reference power Vref and the threshold voltage of the first transistor M1.

Here, the voltage corresponding to the threshold voltage of the first transistor M1 may be stored in the second capacitor C2. Additionally, the current from the first transistor M1 may flow to the reference power Vref via the sixth transistor.

The first control signal might not be supplied to the first control line CL1 during the third period T3. Accordingly, the fourth transistor M4 may be turned off. The data signal DS may be supplied to the data line Dm during the third period T3. The data signal DS supplied to the data line Dm may be supplied to the third node N3. The third node N3 may be set to the voltage of the data signal DS. The first node N1 may maintain the voltage of the reference power Vref. Accordingly, the voltage corresponding to the data signal DS may be stored in the first capacitor C1. Additionally, the second node N2 maybe set to a floating state during the third period T3. Accordingly, the second capacitor C2 may maintain the voltage charged in the preceding period. In other words, the voltage of the first node N1 to the third node N3 may correspond to Formula 1 during the third period T3.

The supply of the first emission control signal to the first emission control line E1 may be stopped during the fourth period T4. Accordingly, the third transistor M3 may be turned on. Also, the supply of the second emission control signal to the second emission control line E2 may be stopped, and accordingly, the seventh transistor M7 may be turned on. Further, the supply of the scan signal to the scan line Sn may be stopped, and accordingly, the second transistor M2 may be turned off. Also, the fourth transistor M4 is turned on as the first control signal is supplied to the first control line CL1 during the fourth period T4. Additionally, the supply of the second control signal and the third control signal to the second control line CL2 and the third control line CL3 may be stopped, and the fifth transistor M5 and the sixth transistor M6 may thereby be turned off.

When the seventh transistor M7 is turned on, the first transistor M1 and the organic light emitting diode OLED may be electrically coupled. When the third transistor M3 is turned on, the voltage of the first power ELVDD may be supplied to the second node N2. The voltage of the second node N2 may increase to the voltage of the first power ELVDD from the voltage that is a sum of the voltage of the reference power Vref and the threshold voltage of the first transistor M1. Here, because the third node N3 and the first node N1 are set to a floating state, the first capacitor C1 and the second capacitor C2 maintain the voltage of the preceding period. During the fourth period T4, the voltage of the first node N1, the voltage of the second node N2, and the third node N3 may correspond to Formula 2.

When the fourth transistor M4 is turned on, the second node N2 and the first transistor M1 may be electrically coupled. The first transistor M1 may control the amount of the current flowing from the first power ELVDD to the second power ELVSS via the organic light emitting diode OLED in response to the voltage of the first node N1. Therefore, the organic light emitting diode OLED may generate light having luminance corresponding to the amount of the current supplied from the first transistor M1 during the fourth period T4. Additionally, the current I supplied from the first transistor M1 to the organic light emitting diode OLED during the fourth period T4 may correspond to Formula 3.

The current flowing from the first transistor M1 to the organic light emitting diode OLED during the fourth period T4 may be determined independently of the first power ELVDD and the threshold voltage of the first transistor M1. Accordingly, display quality may be enhanced.

Figure 8:
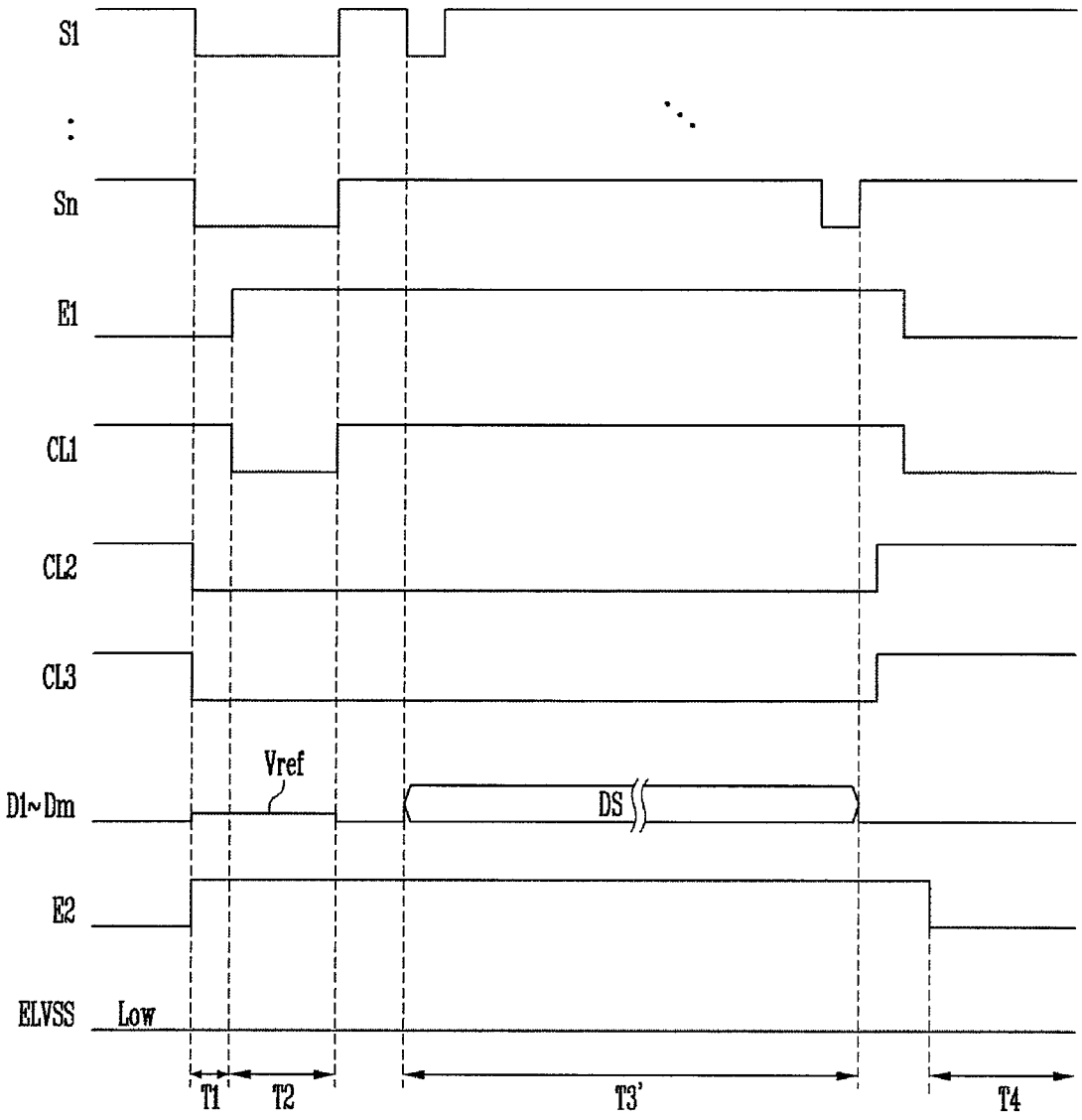
FIG. 8 illustrates an embodiment in which the driving waveform shown in FIG. 7 is applied in concurrent driving.

FIG. 8 illustrates an embodiment in which the driving waveform shown in FIG. 7 is applied in concurrent driving.

Referring to FIG. 8, when the pixels 142 are driven with concurrent driving, the second emission control signal may be supplied to the second emission control line E2 during the first period T1 to the third period 13'. Therefore, the seventh transistor M7 is turned off during the first period T1 to the third period T3'. Accordingly, the organic light emitting diode OLED may be set to a non-light emitting state. The second power ELVSS may maintain a low voltage during the first period T1 to the fourth period T4.

If the pixels 142 are driven using a concurrent driving method, the scan signal may be concurrently supplied to the scan lines S1 to Sn during the first period T1 and the second period T2. The threshold voltage of the first transistor M1 may be compensated in each of the pixels 142 during the first period T1 and the second period T2.

If the pixels 142 compensate the threshold voltage concurrently, sufficient time may be allocated in the second period T2, and accordingly, each of the pixels 142 may compensate the threshold voltage of the first transistor M1 in a stable manner.

The scan signal may be sequentially supplied to the scan lines S1 to Sn during the third period 13'. The data signal DS may be supplied to the data lines D1 to Dm. The pixels 142 may be sequentially selected by the scan signal supplied to the scan lines S1 to Sn, and may store the voltage corresponding to the data signal DS.

The pixels 142 may concurrently emit light in the fourth period T4 in response to the voltage of the data signal DS stored the third period T3'.

The driving waveform shown in FIG. 8 shows that the data signal DS is sequentially stored in horizontal line units. The pixels 142 may be driven substantially the same as they are driven with respect to the driving waveform shown in FIG. 7.

Figure 9:
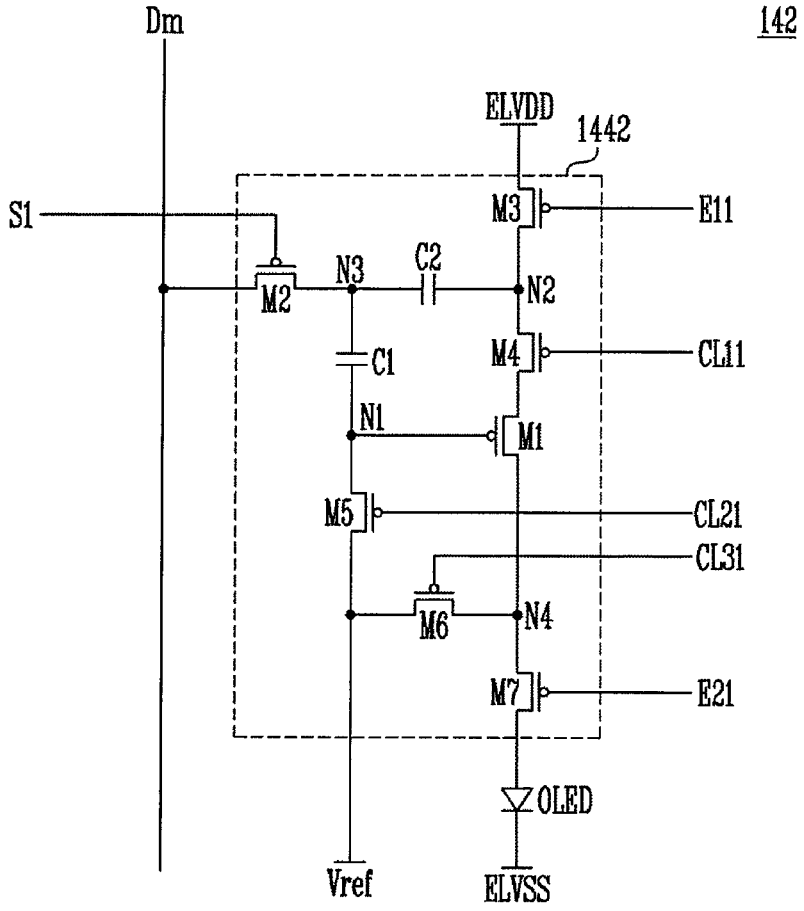
FIG. 9 illustrates a pixel according to a fourth embodiment.

FIG. 9 illustrates a pixel according to a fourth embodiment. As FIG. 9 is explained, the components that are the same as those in FIG. 6 will be given the same reference numerals, and any repetitive description will be omitted. For convenience of illustration, in FIG. 9, the pixel coupled to the first scan line S1 and the m-th data line Dm will be shown.

The pixel 142 may be driven according to a sequential driving method, and the first emission control line E11, the second emission control line E21, the first control line CL11, the second control line CL21 and the third control line CL31 may be formed in every horizontal line (e.g., in every row of pixels).

In the pixel 142 shown in FIG. 9, the pixel circuit 1442 is substantially the same as the pixel circuit 1441 shown in FIG. 6. Accordingly, the detailed description thereof will be omitted.

Figure 10:
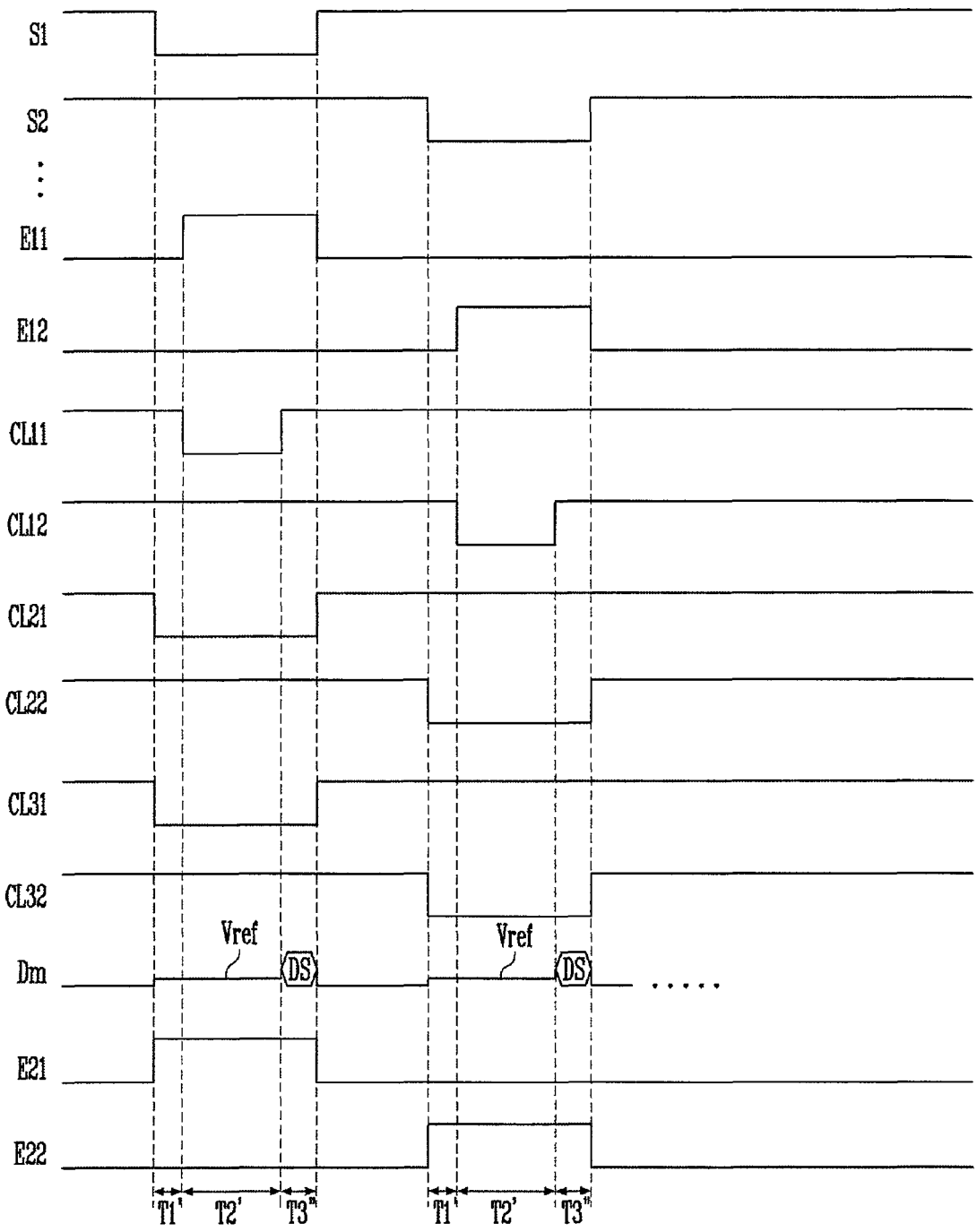
FIG. 10 illustrates an embodiment of a method for driving the pixel shown in FIG. 9.

FIG. 10 illustrates an embodiment of a method for driving the pixel shown in FIG. 9.

Referring to FIG. 10, if the pixels 142 are driven using sequential driving, the scan signal may be sequentially supplied to the scan lines S1 to Sn, the first emission control signal may be sequentially supplied to the first emission control lines E11, E12, . . . , E1n, and the second emission control signal may be sequentially supplied to the second emission control lines E21, E22, E2n. Similarly, the first control signal may be sequentially supplied to the first control lines CL11, CL12, CL1n, the second control signal may be sequentially supplied to the second control lines CL21, CL22, CL2n, and the third control signal may be sequentially supplied to the third control lines CL31, CL32, CL3n.

The scan signal supplied to the first scan line 51 may be supplied during a first period T1', a second period T2', and a third period T3". The second control signal may be supplied to the first second control line CL21, the second control signal may be supplied to the first third control line CL31, and the second emission control signal may be supplied to the first second emission control line E21 during the first period T1', the second period 12', and the third period T3".

The first control signal may be supplied to the first first control line CL11 during the second period T2', and the first emission control signal may be supplied to the first first emission control line E11 during the second period T2' and the third period T3".

The operations are described as follows. First, the second transistor M2 may be turned on by the scan signal that is supplied to the first scan line S1. The fifth transistor M5 may be turned on in response to the second control signal supplied to the first second control line CL21, and the sixth transistor M6 may be turned on in response to the third control signal supplied to the first third control line CL31. The seventh transistor M7 may be turned off in response to the second emission control signal supplied to the first second emission control line E21.

When the seventh transistor M7 is turned off, the fourth node N4 and the organic light emitting diode OLED may be electrically blocked, and accordingly, the organic light emitting diode OLED may be set to the non-light emitting state.

When the sixth transistor M6 is turned on, the voltage of the reference power Vref may be supplied to the fourth node N4. When the second transistor M2 is turned on, the voltage of the reference power Vref from the data line Dm may be supplied to the third node N3. When the fifth transistor M5 is turned on, the voltage of the reference power Vref may be supplied to the first node N1. Here, the third node N3 and the first node N1 may be set to the same voltage, and accordingly, the first capacitor C1 may be initialized.

Additionally, the third transistor M3 may maintain a turn on state during the first period T1', and the second node N2 may thereby be set to the voltage of the first power ELVDD.

During the second period T2', the third transistor M3 may be turned off because the first emission control signal is supplied to the first first emission control line E11. During the second period T2', the fourth transistor M4 may be turned on as the first control signal is supplied to the first first control line CL11.

When the third transistor M3 is turned off, the first power ELVDD and the second node N2 are electrically blocked. When the fourth transistor M4 is turned on, the second node N2 and the first transistor M1 may be electrically coupled.

During the second period T2', the first node N1 and the third node N3 may maintain the voltage of the reference power Vref. Accordingly, during the second period T2', the voltage of the second node N2 may drop from the voltage of the first power ELVDD to the voltage that is a sum of the reference power Vref and the threshold voltage of the first transistor M1. The voltage corresponding to the threshold voltage of the first transistor M1 may be stored in the second capacitor C2. Additionally, the current from the first transistor M1 may flow to the reference power Vref via the sixth transistor M6.

The first control signal to the first first control line CL11 might not be supplied in the third period T3", and accordingly, the fourth transistor M4 may be turned off. The data signal DS may be supplied to the data line Dm during the third period T3". The data signal DS supplied to the data line Dm may be supplied to the third node N3. The third node N3 may be set to the voltage of the data signal DS. The first node N1 may maintain the voltage of the reference power Vref, and accordingly, the voltage corresponding to the data signal DS may be stored in the first capacitor C1. Additionally, the second node N2 may be set to the floating state during the third period T3", and accordingly, the second capacitor C2 may maintain the voltage charged in the preceding period.

Thereafter, the supply of the scan signal to the first scan line S1 may be stopped, the supply of the first emission control signal to the first first emission control line E11 may be stopped, the supply of the second emission control signal to the first second emission control line E21 may be stopped, the supply of the second control signal to the first second control line CL21 may be stopped, and the supply of the third control signal to the first third control line CL31 may be stopped.

When the supply of the first emission control signal to the first first emission control line E11 is stopped, the third transistor M3 may be turned on. When the supply of the second emission control signal to the first second emission control line E21 is stopped, the seventh transistor M7 may be turned on. When the supply of the scan signal to the first scan line S1 is stopped, the second transistor M2 may be turned off.

When the first control signal is supplied to the first first control line CL11, the fourth transistor M4 may be turned on. When the supply of the second control signal and the third control signal to the first second control line CL21 and the first third control line CL31 is stopped, the fifth transistor M5 and the sixth transistor M6 may be turned off.

When the seventh transistor M7 is turned on, the first transistor M1 and the organic light emitting diode OLED may be electrically coupled. When the third transistor M3 is turned on, the voltage of the first power ELVDD may be supplied to the second node N2. When the fourth transistor M4 is turned on, the second node N2 and the first transistor M1 may be electrically coupled. The first transistor M1 may control the amount of the current flowing from the first power ELVDD to the second power ELVSS via the organic light emitting diode OLED in response to the voltage of the first node N1.

Thereafter, as the scan signal is sequentially supplied to the second scan line S2 to the n-th scan line Sn, the above-described processes are repeated.

Figure 11:
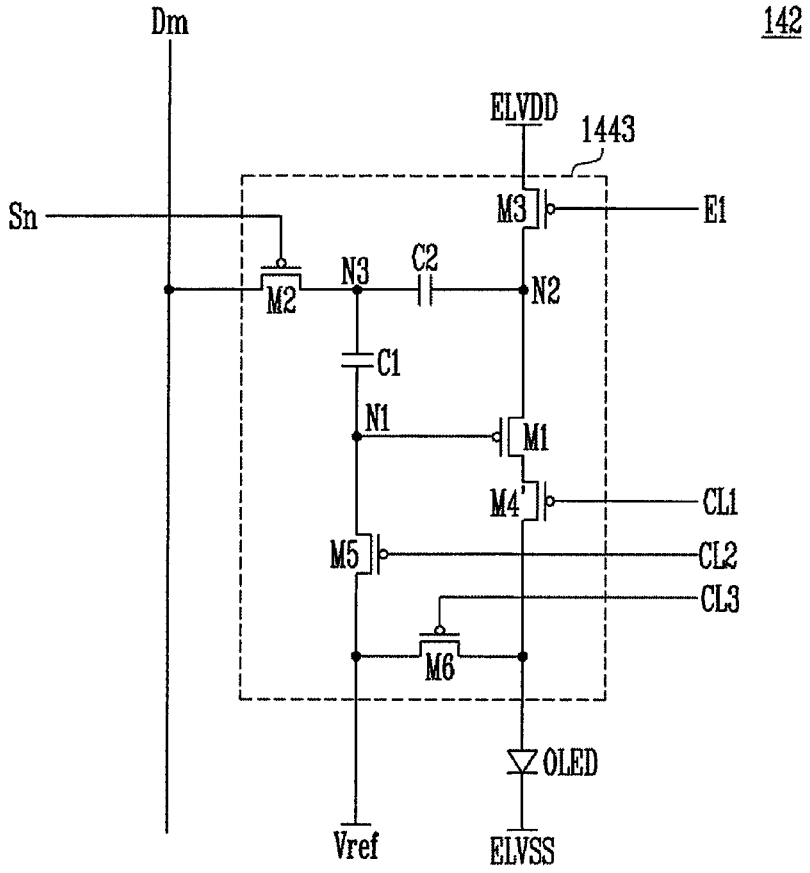
FIG. 11 illustrates a pixel according to a fifth embodiment.

FIG. 11 illustrates a pixel according to a fifth embodiment. As FIG. 11 is explained, the components that are the same as those in FIG. 2 will be given the same reference numerals, and any repetitive description will be omitted.

Referring to FIG. 11, the pixel 142 according to the present embodiment may include the organic light emitting diode OLED and the pixel circuit 1443 for controlling the amount of the current supplied to the organic light emitting diode OLED.

The pixel circuit 1443 may include a fourth transistor M4' coupled between the second electrode of the first transistor M1 and the organic light emitting diode OLED. The gate electrode of the fourth transistor M4' may be coupled to the first control line CL1. The fourth transistor M4' may be turned on when the first control signal is supplied to the first control line CL1, electrically coupling the first transistor M1 and the organic light emitting diode OLED.

The pixel 142 according to the present embodiment operates the same as the pixel shown in FIG. 2, and is different from it only with respect to the position of the fourth transistor M4'. Therefore, the description of the detailed operations will be omitted.

Figure 12:
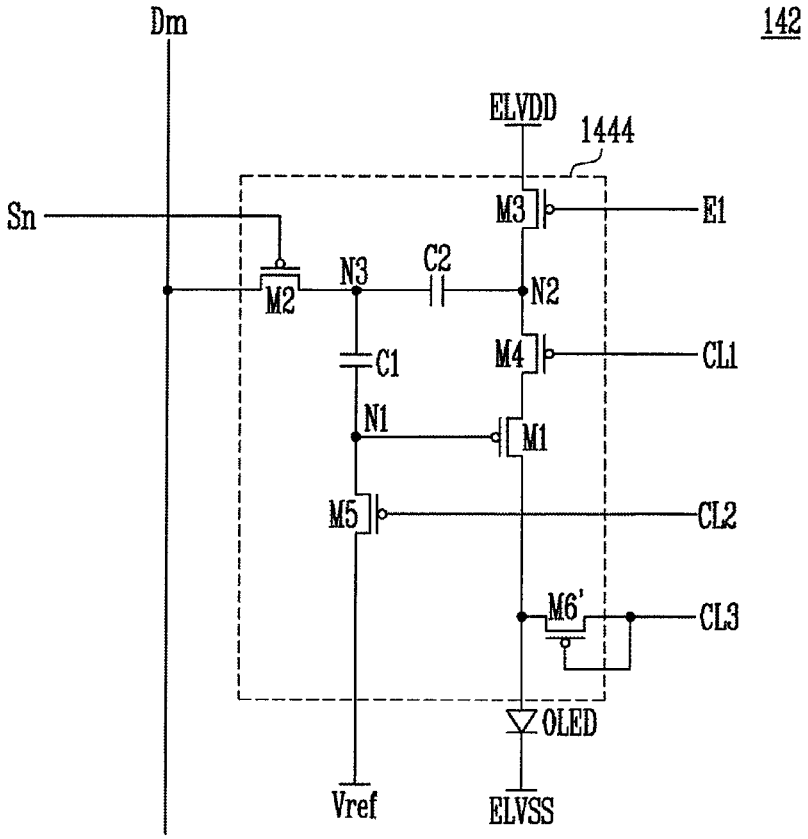
FIG. 12 illustrates a pixel according to a sixth embodiment.

FIG. 12 illustrates a pixel according to a sixth embodiment. As FIG. 12 is explained, the components which are the same as those in FIG. 2 will be given the same reference numerals, and any repetitive description will be omitted.

Referring to FIG. 12, the pixel 142 according to the present embodiment may include the organic light emitting diode OLED and the pixel circuit 1444 for controlling the amount of the current supplied to the organic light emitting diode OLED.

The first electrode of a sixth transistor M6' included in the pixel circuit 1444 may be coupled to the anode electrode of the organic light emitting diode OLED, and the gate electrode and the second electrode of the sixth transistor M6' may be coupled to the third control line CL3. That is, the sixth transistor M6' may be diode-connected, and may be turned on when the control signal is supplied to the third control line CL3.

When the sixth transistor M6' is turned on, the current may be supplied from the first transistor M1 to the third control line CL3 during the second period T2. During the second period T2, the voltage of the reference power Vref may be prevented from changing due to the current of the first transistor M1 during the second period 12.

The pixel 142 according to the present embodiment may operate the same as the pixel in FIG. 2, with the exception of the position of the sixth transistor M6' being changed. Therefore, detailed driving processes will be omitted.

Figure 13:
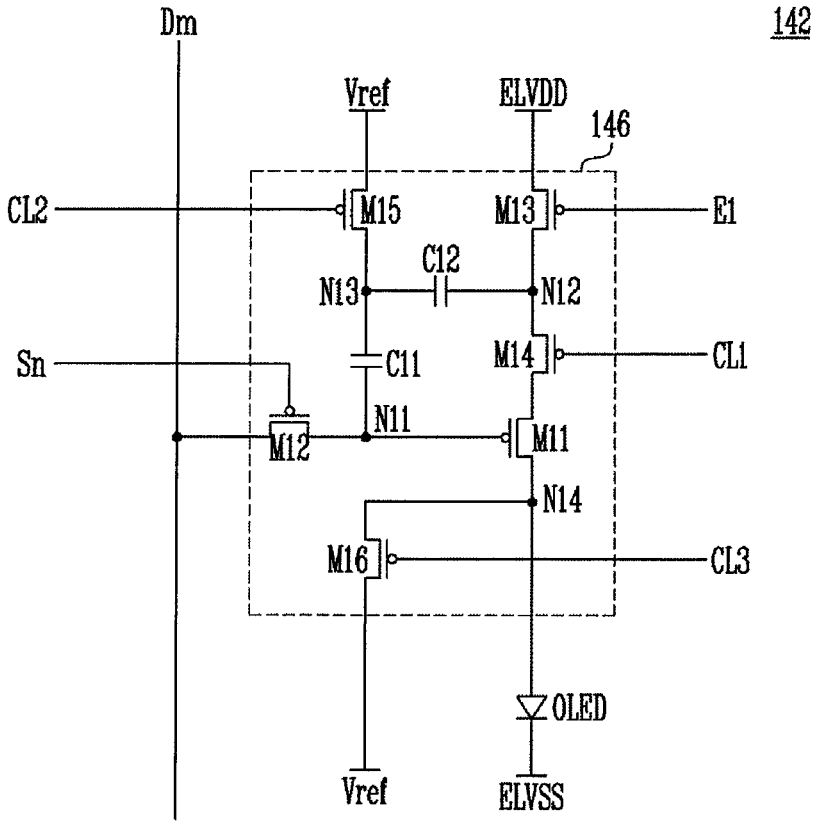
FIG. 13 illustrates a pixel according to a seventh embodiment.

FIG. 13 illustrates a pixel according to a seventh embodiment. FIG. 13, shows the pixel coupled to the m-th data line Dm and the n-th scan line Sn.

Referring to FIG. 13, the pixel 142 according to the present embodiment may include the organic light emitting diode OLED, and the pixel circuit 146 for controlling the amount of the current supplied to the organic light emitting diode OLED.

The anode electrode of the organic light emitting diode OLED may be coupled to the pixel circuit 146, and the cathode electrode may be coupled to the second power ELVSS. The organic light emitting diode OLED may generate light having luminance corresponding to the amount of the current supplied from the pixel circuit 146. For this, the first power ELVDD may be set to a higher voltage than the second power ELVSS.

The pixel circuit 146 may control the amount of the current flowing to the organic light emitting diode OLED in response to the data signal DS. For this, the pixel circuit 146 may include first to sixth transistors M11 to M16, the first capacitor C11, and the second capacitor C12.

The first electrode of the first transistor M11 may be coupled to the first power ELVDD via the fourth transistor M14, a second node N12, and the third transistor M13, and the second electrode of the first transistor M11 may be coupled to the anode electrode of the organic light emitting diode OLED. The gate electrode of the first transistor M11 may be coupled to the first node N11. The first transistor M11 may control the amount of the current flowing from the first power ELVDD to the second power ELVSS via the organic light emitting diode OLED in response to the voltage of the first node N11.

The second transistor M12 may be coupled between the data line Dm and the first node N11. The gate electrode of the second transistor M12 may be coupled to the scan line Sn. The second transistor M12 may be turned on when the scan signal is supplied to the scan line Sn, thereby electrically coupling the data line Dm and the first node N11.

The third transistor M13 may be coupled between the first power ELVDD and the second node N12. The gate electrode of the third transistor M13 may be coupled to the first emission control line E1. The third transistor M13 may be turned off when the first emission control signal is supplied to the first emission control line E1 and may be turned on in other circumstances. As the third transistor M13 is turned on, the voltage of the first power ELVDD may be supplied to the second node N12.

The fourth transistor M14 may be coupled between the second node N12 and the first electrode of the first transistor M11. The gate electrode of the fourth transistor M14 may be coupled to the first control line CL1. The fourth transistor M14 may be turned on when the first control signal is supplied to the first control line CL1, thereby electrically coupling the first transistor M11 and the second node N12.

The fifth transistor M15 may be coupled between the third node N13 and the reference power Vref. The gate electrode of the fifth transistor M15 may be coupled to the second control line CL2. The fifth transistor M15 may be turned on when the second control signal is supplied to the second control line CL2, thereby supplying the voltage of the reference power Vref to the third node N13.

The sixth transistor M16 may be coupled between the anode electrode of the organic light emitting diode OLED and the reference power Vref. The gate electrode of the sixth transistor M16 may be coupled to the third control line CL3. The sixth transistor M16 may be turned on when the third control signal is supplied to the third control line CL3, thereby supplying the voltage of the reference power Vref to the anode electrode of the organic light emitting diode OLED.

The first capacitor C11 may be coupled between the first node N11 and the third node N13. The second capacitor C12 may be coupled between the second node N12 and the third node N13. The first capacitor C11 and the second capacitor C12 may respectively charge a voltage in response to the data signal DS.

In the pixel 142 according to the present embodiment, the positions of transistors M12 and M15 may be different from the corresponding transistors M2 and M5 of the pixel shown in FIG. 2. The pixel 142 according to the present embodiment may be driven by the same driving waveform as the pixel shown in FIG. 2.

The method of driving the pixel 142 according to the present embodiment will be described with reference to the waveform in FIG. 3. The second transistor M12 may be turned on in response to the scan signal supplied to the scan line Sn during the first period T1. The fifth transistor M15 may be turned on in response to the second control signal supplied to the second control line CL2, and the sixth transistor M16 may be turned on in response to the third control signal supplied to the third control line CL3.

When the sixth transistor M16 is turned on, the voltage of the reference power Vref may be supplied to the anode electrode of the organic light emitting diode OLED. When the second transistor M12 is turned on, the data line Dm and the first node N11 may be electrically coupled. The voltage of the reference power Vref from the data line Dm may be supplied to the first node N11. When the fifth transistor M15 is turned on, the voltage of the reference power Vref may be supplied to the third node N13. Here, the third node N13 and the first node N11 may be set to the same voltage, and accordingly, the first capacitor C11 may be initialized. Additionally, because the third transistor M13 may maintain the turn on state during the first period T1, the second node N12 may be set to the voltage of the first power ELVDD.

The third transistor M13 may be turned off as the first emission control signal is supplied to the first emission control line E1 in the second period 12. In the second period 12, the fourth transistor M14 is turned on as the first control signal is supplied to the first control line CL1.

When the third transistor M13 is turned off, the first power ELVDD and the second node N12 may be electrically blocked. When the fourth transistor M4 is turned on, the second node N12 and the first transistor M11 may be electrically coupled.

Here, the first node N11 and the third node N13 may maintain the voltage of the reference power Vref during the second period 12. Therefore, during the second period 12, the voltage of the second node N12 may drop from the voltage of the first power ELVDD to the voltage that is a sum of the reference power Vref and the threshold voltage of the first transistor M1. The voltage corresponding to the threshold voltage of the first transistor M11 may be stored in the second capacitor C12. Additionally, because the second power ELVSS is set to a high voltage, the current from the first transistor M11 may flow to the reference power Vref via the sixth transistor M16.

In the third period 13, the supply of the first control signal to the first control line CL1 may be stopped, and accordingly, the fourth transistor M14 may be turned off. The data signal DS may be supplied to the data line Dm during the third period 13.

The data signal DS supplied to the data line Dm may be supplied to the first node N11. The first node N11 may be set to the voltage of the data signal DS. The third node N13 may maintain the voltage of the reference power Vref, and accordingly, the voltage corresponding to the data signal DS may be stored in the first capacitor C11. Additionally, the second node N12 may be set to the floating state during the third period T3, and accordingly, the second capacitor C12 may maintain the voltage charged in the preceding period. In other words, during the third period T3, the voltage of the first node N11, the voltage of the second node N12, and the third node N13 may correspond to Formula 4.

N11=Vdata N12=Vref+Vth N13=Vref Formula 4

In the fourth period T4, the supply of the first emission control signal to the first emission control line E1 may be stopped, and the third transistor M13 may be turned on, and the supply of the scan signal to the scan line Sn may be stopped, and the second transistor M12 may be turned off. Also, in the fourth period T4, the first control signal may be supplied to the first control line CL1, and the fourth transistor M14 may be turned on, and the supply of the second control signal and the third control signal to the second control line CL2 and the third control line CL3 may be stopped, and the fifth transistor M15 and the sixth transistor M16 may be turned off.

When the third transistor M13 is turned on, the voltage of the first power ELVDD may be supplied to the second node N12. The voltage of the second node N12 may increase to the voltage of the first power ELVDD from the voltage that is a sum of the voltage of the reference power Vref and the threshold voltage of the first transistor M11. Here, because the third node N13 and the first node N11 are set to the floating state, the first capacitor C11 and the second capacitor C12 may maintain the voltage of the preceding period. During the fourth period T4, the voltage of the first node N11, the voltage of the second node N12, and the voltage of the third node N13 may correspond to Formula 5.

N11=Vdata+ΔN12=Vdata+ELVDD−(Vref+Vth) N12=ELVDD N13=Vref+ΔN12=Vref+ELVDD−(Vref+Vth) Formula 5

When the fourth transistor M14 is turned on, the second node N12 and the first transistor M11 may be electrically coupled. The first transistor M11 may control the amount of the current flowing from the first power ELVDD to the second power ELVSS via the organic light emitting diode OLED in response to the voltage of the first node N11. Therefore, the organic light emitting diode OLED may generate light having luminance corresponding to the amount of the current supplied from the first transistor M11. Additionally, during the fourth period T4, the current I supplied to the organic light emitting diode OLED supplied from the first transistor M11 may correspond to Formula 6.

$$I = k(Vsg - |Vth|)^2 = k(Vref - Vdata)^2 \quad \text{Formula 6}$$

The current I supplied to the organic light emitting diode OLED as described in Formula 6 may be determined without regard to the first power ELVDD or to the threshold voltage of the first transistor M1. Therefore, the current may be supplied to the organic light emitting diode OLED without being effected by the voltage drop of the first power ELVDD and the threshold voltage deviation of the first transistor M11. Accordingly, reliability in display qualities may be secured.

Additionally, in Formula 3, grayscale may be realized corresponding to Vdata-Vref, and in Formula 6, grayscale may be realized corresponding to Vref-Vdata. Therefore, the pixel in FIG. 2 and the pixel in FIG. 13 may be provided such that the voltage of the data signal DS may be reversed. For example, but without limitation, the data signal corresponding to the white grayscale in the pixel in FIG. 2 may be set to a data signal corresponding to the black grayscale in the pixel of FIG. 13.

As described above, the pixel 142 according to the present embodiment may be driven by the same driving waveform as the pixel shown in FIG. 2. In other words, it is possible to drive the pixel 142 according to the present embodiment in the same manner by using the concurrent driving method shown in FIG. 4, and repetitive description will be omitted.

Figure 14:
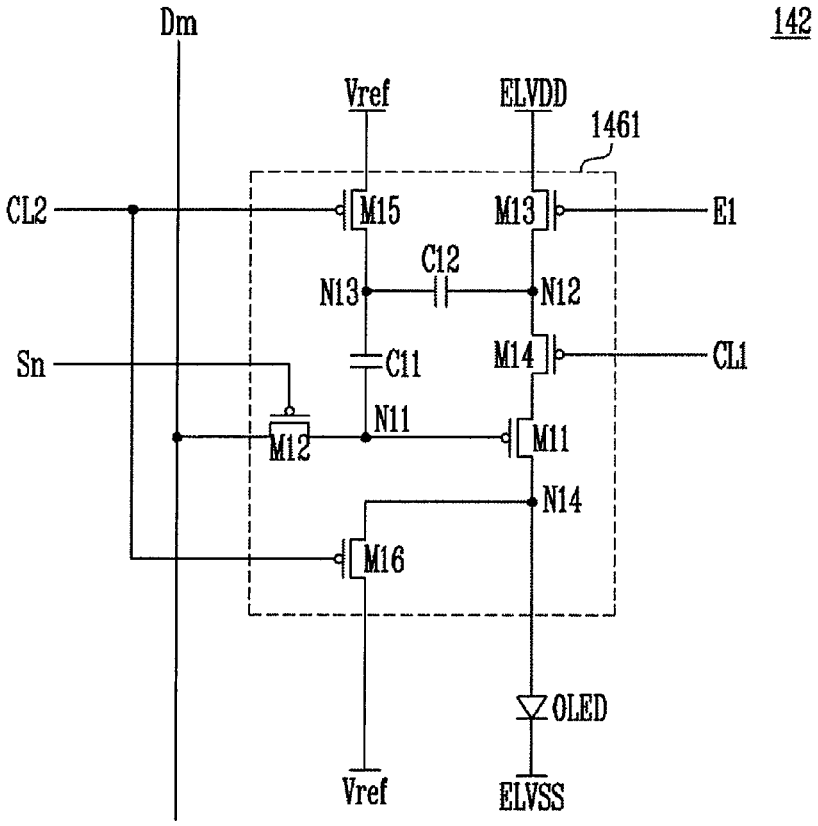
FIG. 14 illustrates a pixel according to an eighth embodiment.

FIG. 14 illustrates a pixel according to an eighth embodiment. As FIG. 14 is explained, the components which are the same as those in FIG. 13 will be given the same reference numerals, and any repetitive description will be omitted.

Referring to FIG. 14, the pixel 142 according to the present embodiment may include the pixel circuit 1461 and the organic light emitting diode OLED.

The gate electrode of the sixth transistor M16 included in the pixel circuit 1461 may be coupled to the second control line CL2. As shown in FIG. 3, the second control signal supplied to the second control line CL2 and the third control signal supplied to the third control line CL3 may be set to the same waveform. Therefore, even when the third control line CL3 is omitted and the sixth transistor M16 is coupled to the second control line CL2, the pixel 142 may be driven in the same manner.

Figure 15:
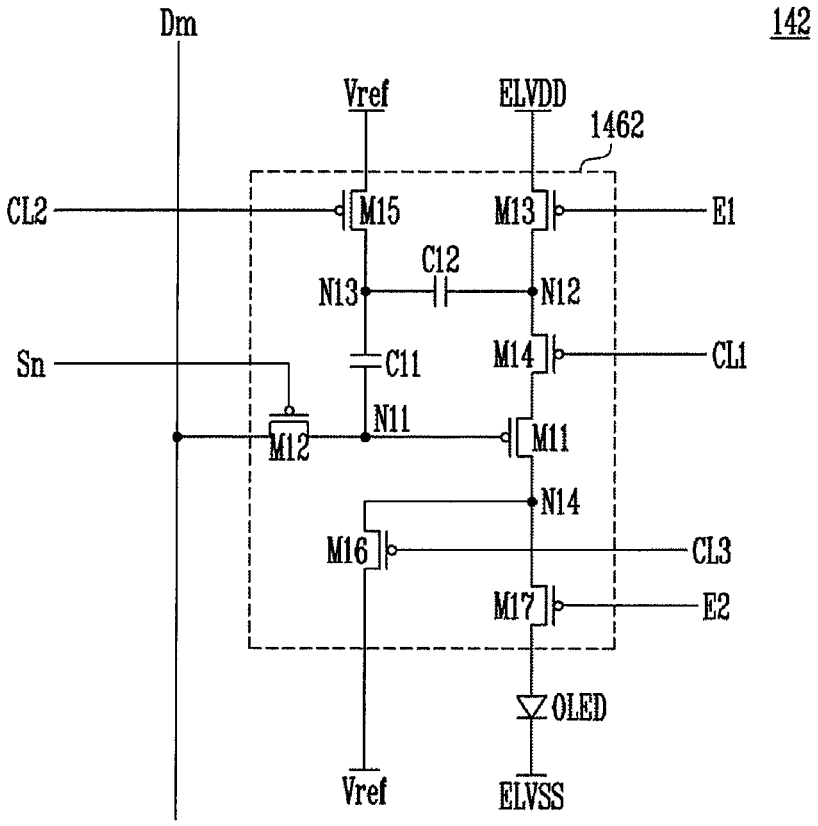
FIG. 15 illustrates a pixel according to a ninth embodiment.

FIG. 15 illustrates a pixel according to a ninth embodiment. As FIG. 15 is explained, the components which are the same as those in FIG. 13 will be given the same reference numerals, and any repetitive description will be omitted.

Referring to FIG. 15, the pixel 142 according to the present embodiment may include the pixel circuit 1462 and the organic light emitting diode OLED.

The pixel circuit 1462 may include the seventh transistor M17 coupled between the fourth node N14 and the anode electrode of the organic light emitting diode OLED. The gate electrode of the seventh transistor M17 may be coupled to the second emission control line E2.

The seventh transistor M17 may be turned off when the second emission control signal is supplied to the second emission control line E2, and may be turned on at other occasions. For example, but without limitation, the seventh transistor M17 may be turned off during the first period T1 to the third period T3, and may be turned on during the fourth period T4.

When the seventh transistor M17 is turned off during the first period T1 and the third period T3, the second power ELVSS may maintain the low voltage during the first period T1 to the third period T3. That is, if the seventh transistor M17 is added to the pixel 142, the second power ELVSS may maintain the low voltage during the first period T1 to the fourth period T4.

Additionally, the pixel 142 shown in FIG. 15 may be driven using the concurrent driving and sequential driving methods. The operation of the pixel 142 is substantially the same as FIG. 13, and thus the detailed description thereof will be omitted.

Figure 16:
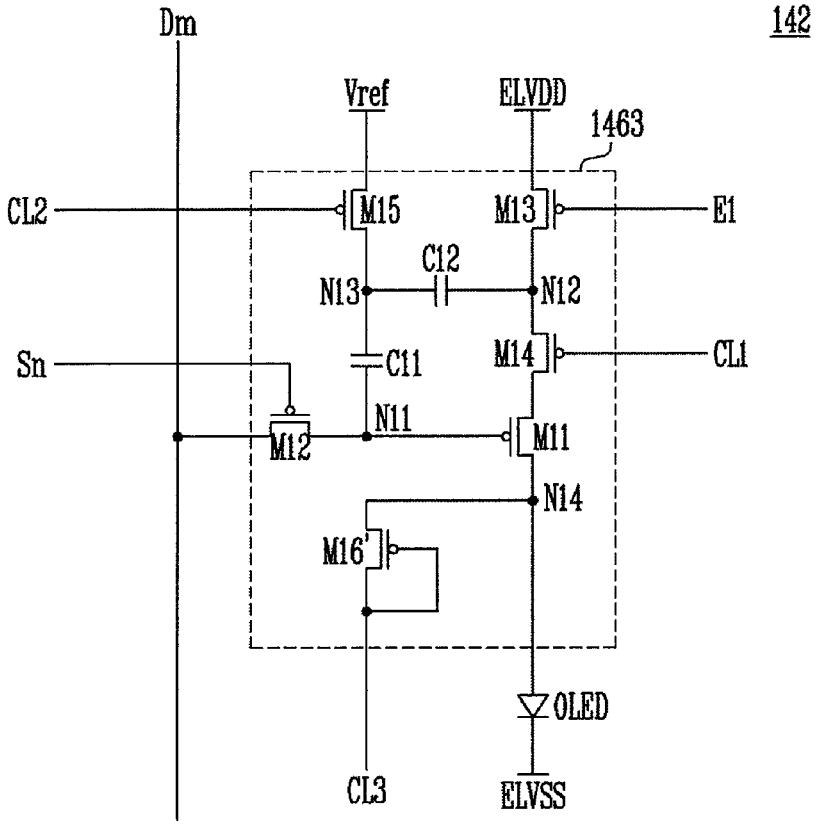
FIG. 16 illustrates a pixel according to a tenth embodiment.

FIG. 16 illustrates a pixel according to a tenth embodiment. As FIG. 16 is explained, the components which are the same as those in FIG. 13 will be given the same reference numerals, and any repetitive description will be omitted.

Referring to FIG. 16, the pixel 142 according to the present embodiment may include the pixel circuit 1463 and the organic light emitting diode OLED.

The first electrode of the sixth transistor M16' included in the pixel circuit 1463 may be coupled to the anode electrode of the organic light emitting diode OLED, and the gate electrode and the second electrode of the sixth transistor M16' may be coupled to the third control line CL3. That is, the sixth transistor M16' may be diode connected and may be turned on when the control signal is supplied to the third control line CL3.

When the sixth transistor M16' is turned on, the current from the first transistor M11 may be supplied to the third control line CL3 from the first transistor M11 during the second period T2. During the second period T2, the voltage of the reference power Vref may be prevented from being changed by the current from the first transistor M11.

The pixel 142 according to the present embodiment may be driven the same as the pixel 142 in FIG. 13, and only the position of the sixth transistor M16' in the two pixels 142 is changed. Therefore, detailed description thereof will be omitted.

Figure 17:
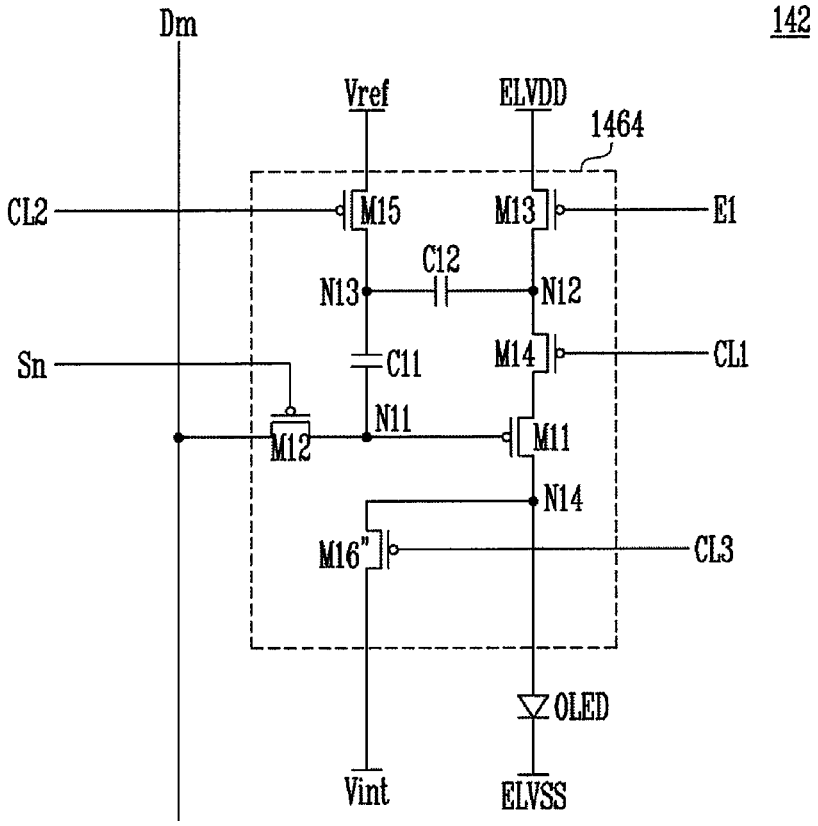
FIG. 17 illustrates a pixel according to an eleventh embodiment.

FIG. 17 illustrates a pixel according to an eleventh embodiment. As FIG. 17 is explained, the components that are the same as those in FIG. 13 will be given the same reference numerals, and any repetitive description will be omitted.

Referring to FIG. 17, the pixel 142 according to the present embodiment may include the pixel circuit 1464 and the organic light emitting diode OLED.

The sixth transistor M16" included in the pixel circuit 1464 may be coupled between the second electrode of the first transistor M11 and the initialization power Vint. The gate electrode of the sixth transistor M16" may be coupled to the third control line CL3 The sixth transistor M16" may be turned on when the third control signal is supplied to the third control line CL3, and the voltage of the initialization power Vint may be supplied to the fourth node N14.

Here, the voltage of the initialization power Vint may be set to a voltage lower than the data signal DS. When the sixth transistor M16" is turned on, the current from the first transistor M11 may be supplied to the initialization power Vint in a stable manner.

In the pixel 142 according to the present embodiment, the sixth transistor M16" may be coupled to the initialization power Vint only, and all other configurations are the same as the pixel in FIG. 13. Therefore, description on the detailed operations thereof will be omitted.

Also, the transistors are illustrated as PMOS for convenience of illustration, the present invention is not limited hereto. In other words, the transistors may be formed as NMOS.

The organic light emitting diode OLED may generate various colors of light including red, green and blue corresponding to the amount of the current supplied from the driving transistor. However, the present invention is not limited hereto. For example, but without limitation, the organic light emitting diode OLED may generate white light corresponding to the amount of the current supplied from the driving transistor. Here, color image may be implemented using color filters or the like.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims and their equivalents.

What is claimed is:

1. A pixel comprising:

an organic light emitting diode;

a first transistor configured to control an amount of a current flowing from a first power to a second power via a second node and the organic light emitting diode in response to a voltage of a first node;

a first capacitor between the first node and a third node;

a second capacitor between the second node and the third node, the second capacitor being directly coupled to the first capacitor;

a second transistor between the third node and a data line and comprising a gate electrode coupled to a scan line, the second transistor being directly coupled to the data line and being directly coupled to both of the first and second capacitors and being configured to transmit a data signal;

a third transistor between the first power and the second node and comprising a gate electrode coupled to a first emission control line, the third transistor being directly coupled to the second capacitor;

a fourth transistor between the second node and the first transistor, and configured to conduct the current flowing from the first power to the second power; and a sixth transistor directly connected to both the organic light emitting diode and a reference power, wherein the reference power and the second power are different powers.

2. The pixel as claimed in claim 1, wherein the second transistor is configured to be turned on in response to a scan signal supplied to the scan line during:

a first period when the third node is initialized;

a second period when a threshold voltage of the first transistor is compensated; and a third period when a voltage corresponding to the data signal is stored.

3. The pixel as claimed in claim 2, wherein a voltage of the reference power is configured to be supplied to the data line during the first period and the second period, and wherein the data signal is configured to be supplied to the data line during the third period.

4. The pixel as claimed in claim 3, wherein the voltage of the reference power is configured to be within a voltage range of data signals configured to be supplied to the data line.

5. The pixel as claimed in claim 2, wherein the second power is configured to be a high voltage during the first period, the second period, and the third period such that the organic light emitting diode is configured to be turned off, and wherein the second power is configured to be a low voltage during a fourth period such that the organic light emitting diode is configured to be turned on.

6. The pixel as claimed in claim 2, wherein the third transistor is configured to be turned on during the first period, and is configured to be turned off during the second period and during the third period.

7. The pixel as claimed in claim 2, wherein the fourth transistor comprises a gate electrode coupled to a first control line.

8. The pixel as claimed in claim 7, wherein the fourth transistor is configured to be turned on during the second period such that the organic light emitting diode emits light.

9. The pixel as claimed in claim 2, further comprising:

a fifth transistor between the first node and the reference power, and comprising a gate electrode coupled to a second control line, wherein the sixth transistor is between an anode electrode of the organic light emitting diode and the reference power, and comprises a gate electrode coupled to a third control line.

10. The pixel as claimed in claim 9, wherein the fifth transistor and the sixth transistor are configured to be turned on during the first period, during the second period, and during the third period, and are configured to be turned off when the organic light emitting diode emits light.

11. The pixel as claimed in claim 9, wherein the second control line is electrically coupled to the third control line.

12. The pixel as claimed in claim 9, wherein the reference power is configured to be within a voltage range of data signals configured to be supplied to the data line.

13. The pixel as claimed in claim 2, further comprising a seventh transistor between the first transistor and an anode electrode of the organic light emitting diode, and comprising a gate electrode coupled to a second emission control line.

14. The pixel as claimed in claim 13, wherein the seventh transistor is configured to be turned off during the first period, during the second period, and during the third period, and is configured to be turned on during a fourth period.

15. The pixel as claimed in claim 2, further comprising:

a fifth transistor between the first node and the reference power, and comprising a gate electrode coupled to a second control line; and wherein the sixth transistor comprises:

a first electrode between an anode electrode of the organic light emitting diode and the first transistor;

a gate electrode coupled to a third control line; and a second electrode coupled to the third control line.

16. The pixel as claimed in claim 15, wherein the fifth transistor and the sixth transistor are configured to be turned on during the first period, during the second period, and during the third period, and are configured to be turned off when the organic light emitting diode emits light.

17. A method of driving a pixel comprising a first transistor configured to control an amount of a current flowing from a first power to a second power via a second node and an organic light emitting diode in response to a voltage of a first node, a first capacitor between the first node and a third node, a second capacitor between the second node and the third node, and a sixth transistor, the method comprising:

supplying a voltage of a reference power to the first node and to the third node;

supplying a voltage of the first power to the second node;

maintaining the voltage of the reference power at the first node and at the third node;

blocking electrical coupling between the second node and the first power;

supplying the voltage of the reference power to the first node;

supplying a voltage of a data signal to the third node via a second transistor; and controlling an amount of a current supplied from the first transistor to the organic light emitting diode in response to voltages of the first capacitor and the second capacitor, wherein the second capacitor is directly coupled to the first capacitor, wherein the second transistor is directly coupled to a data line and is directly coupled to both of the first and second capacitors, the second transistor being configured to transmit the data signal to the third node, wherein a fourth transistor is between the second node and the first transistor, and is configured to conduct the current flowing from the first power to the second power, wherein the sixth transistor is directly connected to both the organic light emitting diode and the reference power, and wherein the reference power and the second power are different powers.

18. The method as claimed in claim 17, further comprising setting the reference power within a voltage range of data signals.

19. The method as claimed in claim 17, further comprising setting the voltage of the second node to a sum of the voltage of the reference power and a threshold voltage of the first transistor during the blocking the electrical coupling.

20. The method as claimed in claim 17, further comprising setting the second node to a floating state during the supplying of the voltage of the data signal to the third node.

* * * * *